US011708840B1

(12) United States Patent
Adhikari

(10) Patent No.: US 11,708,840 B1
(45) Date of Patent: Jul. 25, 2023

(54) ANNULAR COMPRESSION SYSTEM AND A METHOD OF OPERATING THE SAME

(71) Applicants: Anwit Adhikari, Regina (CA); University of Regina, Regina (CA)

(72) Inventor: Anwit Adhikari, Regina (CA)

(73) Assignees: Anwit Adhikari, Regina (CA); University of Regina, Regina (CA)

( * ) Notice: Subject to any disclaimer, the term of this patent is extended or adjusted under 35 U.S.C. 154(b) by 0 days.

(21) Appl. No.: 17/897,512

(22) Filed: Aug. 29, 2022

(51) Int. Cl.

| | |
|---|---|
| ***F04D 17/10*** | (2006.01) |
| ***F04D 29/42*** | (2006.01) |
| ***F04D 29/28*** | (2006.01) |
| ***F04D 25/08*** | (2006.01) |

(52) U.S. Cl.
CPC ..... *F04D 29/4206* (2013.01); *F04D 17/10* (2013.01); *F04D 25/08* (2013.01); *F04D 29/284* (2013.01)

(58) Field of Classification Search
CPC ..... F04D 29/4206; F04D 17/10; F04D 29/284
See application file for complete search history.

(56) References Cited

U.S. PATENT DOCUMENTS

| | | | | |
|---|---|---|---|---|
| 4,930,978 A * | 6/1990 | Khanna | F04D 27/0207 415/914 |
| 5,246,335 A * | 9/1993 | Mitsubori | F04D 29/4213 415/214.1 |
| 8,690,524 B2 * | 4/2014 | Yin | F04D 29/685 415/119 |
| 2020/0032812 A1 * | 1/2020 | Oakman | F04D 29/441 |

* cited by examiner

*Primary Examiner* — Sabbir Hasan
(74) *Attorney, Agent, or Firm* — Bereskin & Parr LLP/S.E.N.C.R.L., s.r.l.

(57) ABSTRACT

Various embodiments are provided herein for a system and method for air compression. In at least some embodiments provided herein, there is provided a compressor device having an annular chamber, at least one inlet port, at least one blade, at least one dynamic partition wall and at least one outlet, wherein when the at least one partition wall is in a closed position, the at least one blade approaching the at least one partition wall causes the air to compress and wherein when the at least one partition wall is in the open position, at least one blade moves from a first side to a second side of the at least one partition wall. The compressor device may contain a gearbox train configured to move the at least one partition wall from the closed position to the open position when the at least one blade is within a predetermined distance.

20 Claims, 23 Drawing Sheets

ANNULAR COMPRESSION SYSTEM AND A METHOD OF OPERATING THE SAME

FIELD

The described embodiments relate generally to a compression device and a corresponding method of operating the same, and specifically, to a compression device that can be used to compress gas and/or fluid, and a method of operating the same.

INTRODUCTION

Compressor systems are generally used to compress gas (such as air), fluid, or a combination of both. Compressor systems can be bulky; especially when combined with other apparatus to treat and/or filter the gas and/or fluid, the compressor systems can become more complex.

One challenge with building a compressor system lies with the requirement that a compression system must have a physical chamber where the air and/or fluid to be compressed is received, and this physical chamber should have a volume that diminishes with time and does so in a continuously repeatable manner. This may result in further increased complexity in compressor designs. It is desirable to provide a compressor system that is compact and simple.

SUMMARY OF VARIOUS EMBODIMENTS

In a first aspect, there is provided a compressor device having an annular chamber with an inner wall and an outer wall, at least one inlet port within the annular chamber, the annular chamber receiving air through the at least one inlet port configured to receive air into the annular chamber, at least one blade in communication with the inner wall and moveable around the annular chamber, the at least one blade configured to compress the air received from the at least one inlet port, and at least one partition wall between the inner wall and the outer wall moveable between a closed position and an open position, where the at least one partition wall is configured to close a space between the inner wall and the outer wall of the annular chamber when in the closed position and configured to create space between the inner wall and the outer wall of the annular chamber when in the open position. When the at least one partition wall is in the closed position, the at least one blade approaching the at least one corresponding partition wall causes the air to compress to generate compressed air and when the at least one partition wall is in the open position, the at least one blade moves from a first side of the corresponding at least one partition wall to a second side of the at least one corresponding partition wall. The compressor device has at least one outlet port within the annular chamber, configured to release the compressed air from the annular chamber after the at least one blade has moved to a second side of the at least one corresponding partition wall.

In one or more embodiments, the compressor device has at least three blades and at least three partition walls, the at least three partition walls forming at least three interior chambers of the annular chamber when in the closed position.

In one or more embodiments, the at least one blade is configured to create a suction force between the at least one blade and the second side of the at least one corresponding partition wall, drawing the air in from the inlet port into the annular chamber.

In one or more embodiments, the at least one partition wall, when in a closed position, forms an airtight seal between the inner wall and the outer wall of the annular chamber.

In one or more embodiments, the at least one partition wall is moveable between the closed position and the open position by a gearbox train, where the gearbox train is configured to open the at least one partition wall when the at least one blade is within a predetermined distance of and approaching the at least one partition wall, and where the gearbox train is configured to close the at least one partition wall when the at least one blade is within a second predetermined distance of and has passed the at least one corresponding partition wall.

In one or more embodiments, the gearbox train has a hub gear in communication with the at least one blade and configured to continuously drive the at least one blade within the device, a motion conversion gear in communication with the hub gear and configured to interact with the hub gear when the at least one blade is located within a predetermined angular distance from the at least one partition wall and causing the conversion of continuous motion of the hub gear into intermittent motion of the motion conversion gear, and a speed amplification gear in communication with the motion conversion gear and configured to convert the intermittent motion of the motion conversion gear into a high-speed intermittent motion of the speed amplification gear. The gearbox train has a reciprocal gear system in communication with the speed amplification gear and configured to rotate when interacting with the speed amplification gear, a central spur gear in communication with the reciprocal gear system and configured to rotate a predetermined degree in a first direction and a predetermined degree in a second direction opposing the first direction, and at least one partition spur gear in communication with the central reciprocal gear and configured to move the at least one partition wall. When the central spur gear moves in the first direction, the at least one partition spur gear is rotated in the second direction and when the central spur gear moves in the second direction, the at least one partition spur gear is rotated in the first direction. The at least one partition wall is moved from a closed position to an open position when the at least one partition spur gear is rotated in the second direction and the at least one partition wall is moved from the open position to the closed position when the at least one partition spur gear is rotated in the first direction.

In one or more embodiments, the reciprocal gear system includes a first reciprocal gear in communication with the speed amplification gear and the central spur gear and configured to rotate in the second direction, and a second reciprocal gear in communication with the first reciprocal gear and the central spur gear and configured to rotate in the first direction.

In one or more embodiments, the first reciprocal gear interacts with the central reciprocal gear to rotate the central reciprocal gear in the first direction and the second reciprocal gear interacts with the central reciprocal gear to rotate the central reciprocal gear in the second direction.

In one or more embodiments, the motion conversion gear has a first layer of a hexagonal shape and a second layer above the first layer, the second layer having an involute curved profile.

In a second aspect, a method of compressing air with a compressor device includes receiving air through an inlet port of the compressor device, the compressor device having an annular chamber comprising an inner wall and an outer wall, at least one inlet port within the annular chamber configured to flow air into the annular chamber, at least one blade in communication with the inner wall and moveable around the annular chamber, the at least one blade configured to compress the air received from the at least one inlet port, and at least one partition wall between the inner wall and the outer wall moveable between a closed position and an open position, where the at least one partition wall is configured to close a space between the inner wall and the outer wall of the annular chamber when in the closed position and configured to create space between the inner wall and the outer wall of the annular chamber when in the open position, and at least one outlet port within the annular chamber, configured to release the compressed air from the annular chamber after the at least one blade has moved to a second side of the at least one corresponding partition wall. The method further includes moving the at least one blade in a continuous motion around the annular chamber, compressing between the at least one blade and the at least one partition wall in the closed position, the received air within the annular chamber, and outputting the compressed air through the outlet port of the compressor device when the at least one partition wall is moved to the open position.

In one or more embodiments, the method includes moving the at least one partition wall from the closed position to the open position to allow the at least one blade to move from a first side of the at least one partition wall to a second side of the at least one partition wall.

In one or more embodiments, the method includes moving the at least one partition wall from the open position to the closed position after the at least one blade has moved to the second side of the at least one partition wall.

In one or more embodiments, the compressor device includes at least three blades and at least three partition walls, the at least three partition walls forming at least three interior chambers of the annular chamber when in the closed position.

In one or more embodiments, a suction force is created between the at least one blade and the second side of the at least one partition wall, drawing the air flow in from the inlet port into the annular chamber.

In one or more embodiments, the method includes moving the at least one partition wall between the closed position and the open position by a gearbox train, wherein the gearbox train is configured to open the at least one partition wall when the at least one blade is within a predetermined distance of and approaching the at least one partition wall, and wherein the gearbox train is configured to close the at least one partition wall when the at least one blade is within a second predetermined distance of and has passed the at least one corresponding partition wall.

In one or more embodiments, the method includes driving the at least one blade around the annular chamber by a hub gear of the gearbox train, the hub gear in communication with a motion conversion gear, converting, by the motion conversion gear, continuous movement of the hub gear to intermittent motion of the motion conversion gear, rotating, by the motion conversion gear, a speed amplification gear configured to convert the intermittent motion of the motion conversion gear into a high-speed intermitted motion of the speed amplification gear, and rotating, by the speed amplification gear, a reciprocal gear system. The method further includes rotating, by the reciprocal gear system, a central spur gear configured to rotate a predetermined degree in a first direction and a predetermined degree in a second direction opposing the first direction, rotating the at least one partition spur gear in a second direction when the central spur gear moves in the first direction, moving the at least one partition wall from a closed position to an open position when the at least one partition spur gear is rotated in the second direction, rotating the at least one partition spur gear in a first direction when the central spur gear moves in the second direction, and moving the at least one partition wall from the open position to the closed position when the at least one partition spur gear is rotated in the first direction.

In one or more embodiments, the motion conversion gear is configured to interact with the hub gear when the at least one blade driven by the hub gear is located within a determined angular distance from the at least one partition wall.

In one or more embodiments, the reciprocal gear system includes a first reciprocal gear in communication with the speed amplification gear and the central spur gear and configured to rotate in the second direction, and a second reciprocal gear in communication with the first reciprocal gear and the central spur gear and configured to rotate in the first direction, wherein the first reciprocal gear is rotated in the second direction when the at least one blade is within a predetermined distance of a first side of the at least one corresponding partition wall, and wherein the second reciprocal gear is rotated in the first direction when the at least one blade has moved to a second side of the at least one corresponding partition wall.

In one or more embodiments, the second reciprocal gear interacts with the central spur gear to rotate the central spur gear in the first direction and the first reciprocal gear interacts with the central spur gear to rotate the central spur gear in the second direction.

BRIEF DESCRIPTION OF THE DRAWINGS

A preferred embodiment of the present invention will now be described in detail with reference to the drawings, in which.

DESCRIPTION OF EXEMPLARY EMBODIMENTS

Figure 1:
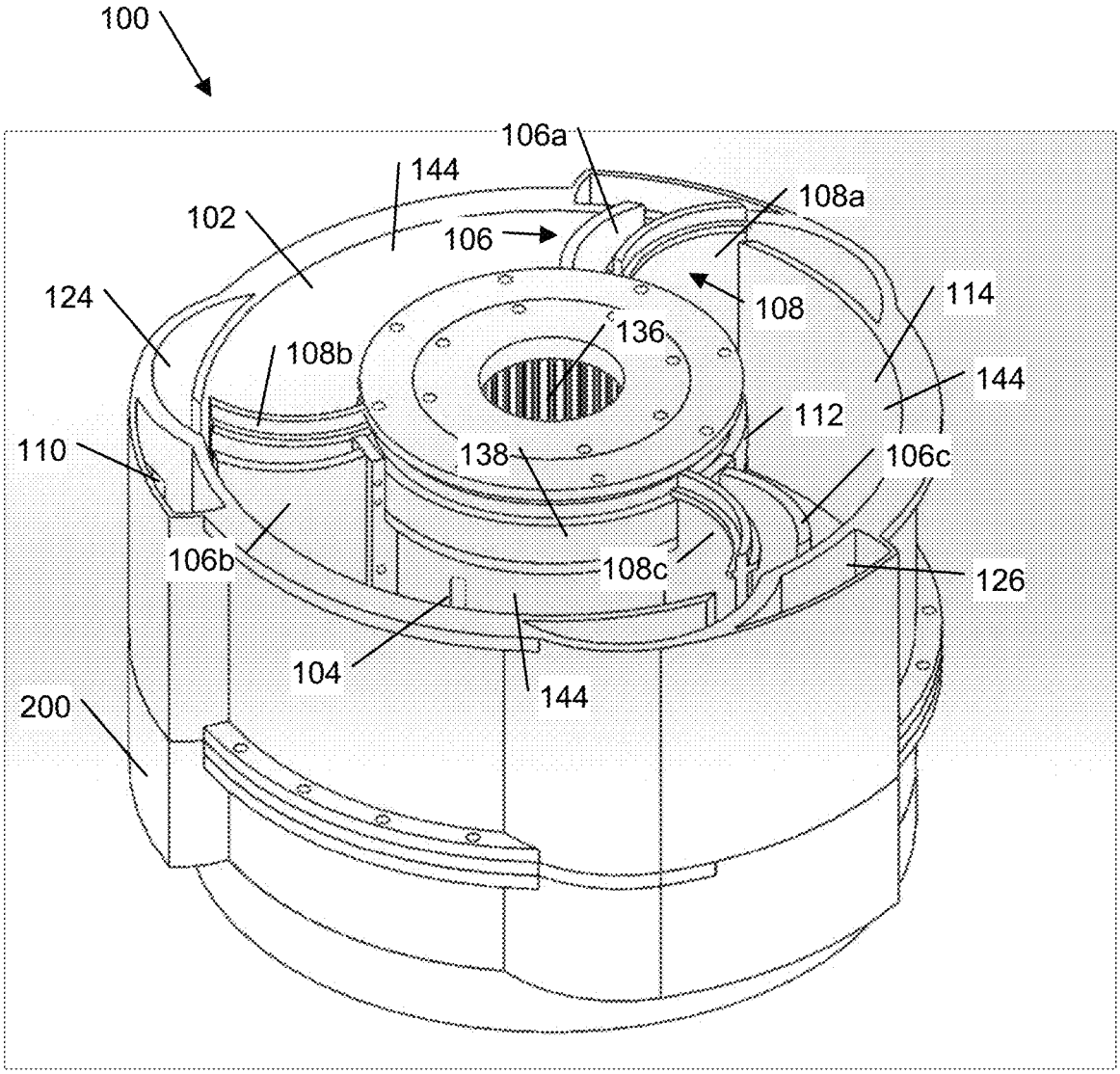
FIG. 1 is a perspective view of an example embodiment of a compressor device.

Various embodiments in accordance with the teachings herein will be described below to provide an example of at least one embodiment of the claimed subject matter. No embodiment described herein limits any claimed subject matter. The claimed subject matter is not limited to devices, systems or methods having all of the features of any one of the devices, systems or methods described below or to features common to multiple or all of the devices, systems or methods described herein. It is possible that there may be a device, system or method described herein that is not an embodiment of any claimed subject matter. Any subject matter that is described herein that is not claimed in this document may be the subject matter of another protective instrument, for example, a continuing patent application, and the applicant(s), inventor(s) or owner(s) do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the example embodiments described herein.

It should also be noted that the terms "coupled" or "coupling" as used herein can have several different meanings depending in the context in which these terms are used. For example, the terms coupled or coupling can have a mechanical, chemical or electrical connotation. For example, as used herein, the terms coupled or coupling can indicate that two elements or devices can be directly connected to one another or connected to one another through one or more intermediate elements or devices via an electrical or magnetic signal, electrical connection, an electrical element or a mechanical element depending on the particular context. Furthermore coupled electrical elements may send and/or receive data.

Unless the context requires otherwise, throughout the specification and claims which follow, the word "comprise" and variations thereof, such as, "comprises" and "comprising" are to be construed in an open, inclusive sense, that is, as "including, but not limited to".

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

Reference throughout this specification to "one embodiment", "an embodiment", "at least one embodiment" or "some embodiments" means that one or more particular features, structures, or characteristics may be combined in any suitable manner in one or more embodiments, unless otherwise specified to be not combinable or to be alternative options.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The headings and Abstract of the Disclosure provided herein are for convenience only and do not interpret the scope or meaning of the embodiments.

Reference is first made to FIG. 1, which illustrates an example embodiment of an annular dynamic partition compressor 100. Compressor 100 can be used to compress air. Compressor 100 can also be used to compress fluid. Even though the description here makes reference to compression of air, the same principles apply to facilitate fluid compression as well.

As shown, the compressor 100 generally includes an annular chamber 102, an inlet port 104, at least one blade 106, at least one partition wall 108 and an outlet port 110. In some embodiments, the compressor 100 may include a motor designed to facilitate movement of the at least one blade 106. In some embodiments, the compressor 100 may include a gearbox train 200 to facilitate movement of the at least one partition wall 108.

The compressor 100 is designed to have a continuous, annular hollow chamber 102. This allows for the compressor 100 to be of a compact design and have the smallest possible physical volume while still fulfilling the desired purpose. In some cases, the compressor 100 may be used in a space or deep-sea exploration, or an application where the compressor 100 may have to be transported long distances. Similarly, the compressor 100 may be used in an application where the access to the compressor 100 may be limited (e.g. compressor 100 may be placed in tight spaces, or it may require a lot of time and/or resources to access the compressor 100). The compressor 100 may also be used in an application where repairing or maintaining the compressor 100 may be limited, requiring a lot of time and/or resources to facilitate its maintenance. In such applications, having a compressor 100 that is compact, simple in design and manufacturing, as well as less complex in operation, becomes highly desirable. For example, in one application, the compressor 100 may be used in space exploration to process air of other planets to make it more breathable by astronauts or humans generally. In another application, the compressor 100 may be used to compress the air to levels higher than standard air pressure to fill up oxygen tanks. In a further example, the compressor 100 may also be used as an internal combustion engine, as discussed in detail below with references to FIGS. 22 and 23.

The compressor 100 designed as shown in the figures allow for additional air treatment components to be added within the inner chamber 136 of the compressor 100. For example, a heater, a filter, an oxygen scrubber, or any other air treatment components, or a combination of these may be added within the inner chamber 136. To this end, a highly compact and vertically integrated air treatment system is created.

Referring back to FIG. 1, the annular chamber 102 is contained within inner wall 112 and outer wall 114. The annular chamber 102 may be of any radial thickness, where the thickness may be as wide or as narrow as is desired. For example, in certain applications in tighter spaces, the annular chamber 102 may be required to be very narrow, while in other application the annular chamber 102 may be of an increased width to allow for a larger volume of air compression. An air compressor for personal use, for example, may only require a narrower chamber 102 than an air compressor for commercial purposes or similar applications.

In the illustrated embodiment, the annular chamber 102 contains three blades 106*a-c* dimensioned to close the space between the inner wall 112 and the outer wall 114 of the annular chamber 102. The three blades 106*a-c* are in communication with one another via a ring 138 that rests on the inner wall 112 of the annular chamber 102. As such, the blades 106*a-c* are provided around the annular chamber 102 so they are generally equidistant from each other. The blades 106*a-c* are configured to rotate around the annular chamber 102 simultaneously so they can continue to stay equidistant from each other.

Blades 106*a-c* may have, as illustrated in FIG. 1, a curved profile. In some embodiment, blades 106*a-c* may have a straight profile. In the illustrated embodiments, blades 106*a-c* extend along the entire height of the annular chamber 102. In some embodiments, blades 106*a-c* may extend along a partial height of the annular chamber 102.

Blades 106*a-c* may have a seal along the edge where the blades 106*a-c* meet the inner wall 112 and the outer wall 114 of the annular chamber. The seal may ensure that the space between the inner wall 112 and the outer wall 114 remains air-tight and as such, does not allow air leakage. This ensures an efficient compression system. [41] As illustrated, the annular chamber 102 contains three partition walls 108*a-c*. The partition walls 108*a-c* are designed to have the same curvature and configuration as the blades 106*a-c*. The partition walls 108*a-c* are located equidistant from one another within the annular chamber 102 and cover the distance between the inner wall 112 and the outer wall 114 of the annular chamber 102, fully blocking air flow within the annular chamber 102. The partition walls 108*a-c* extend along the entire height of the annular chamber 102. The space between two adjacent partition walls 108*a-c* provides an enclosed compression chamber 144. In the illustrated embodiment, partition walls 108*a-c* divide the annular chamber 102 into three compression chambers 144 of equal arc length and volume.

Figure 3:
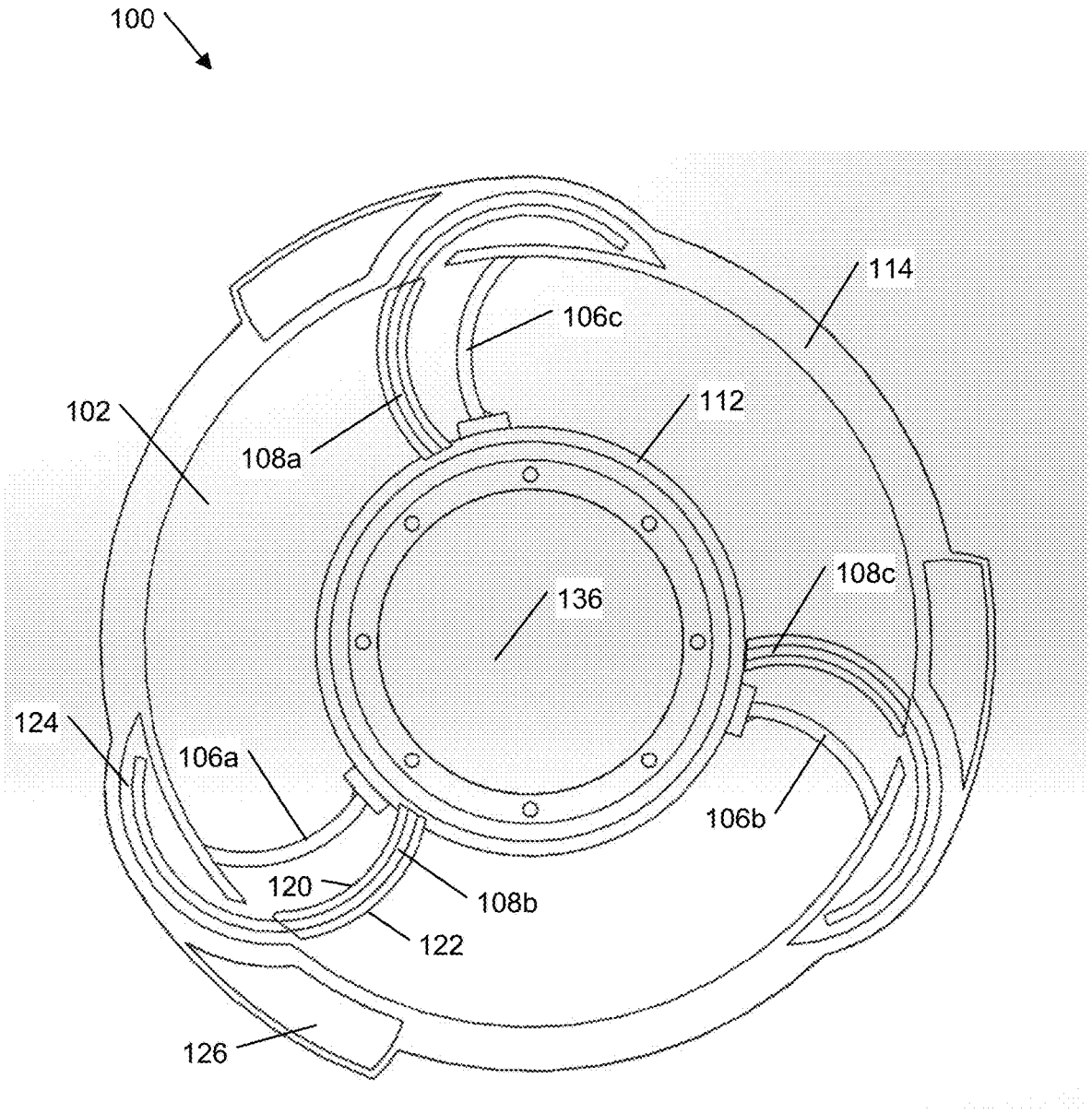
FIG. 3 is a top view of the example compressor device of FIG. 1.
Figure 4:
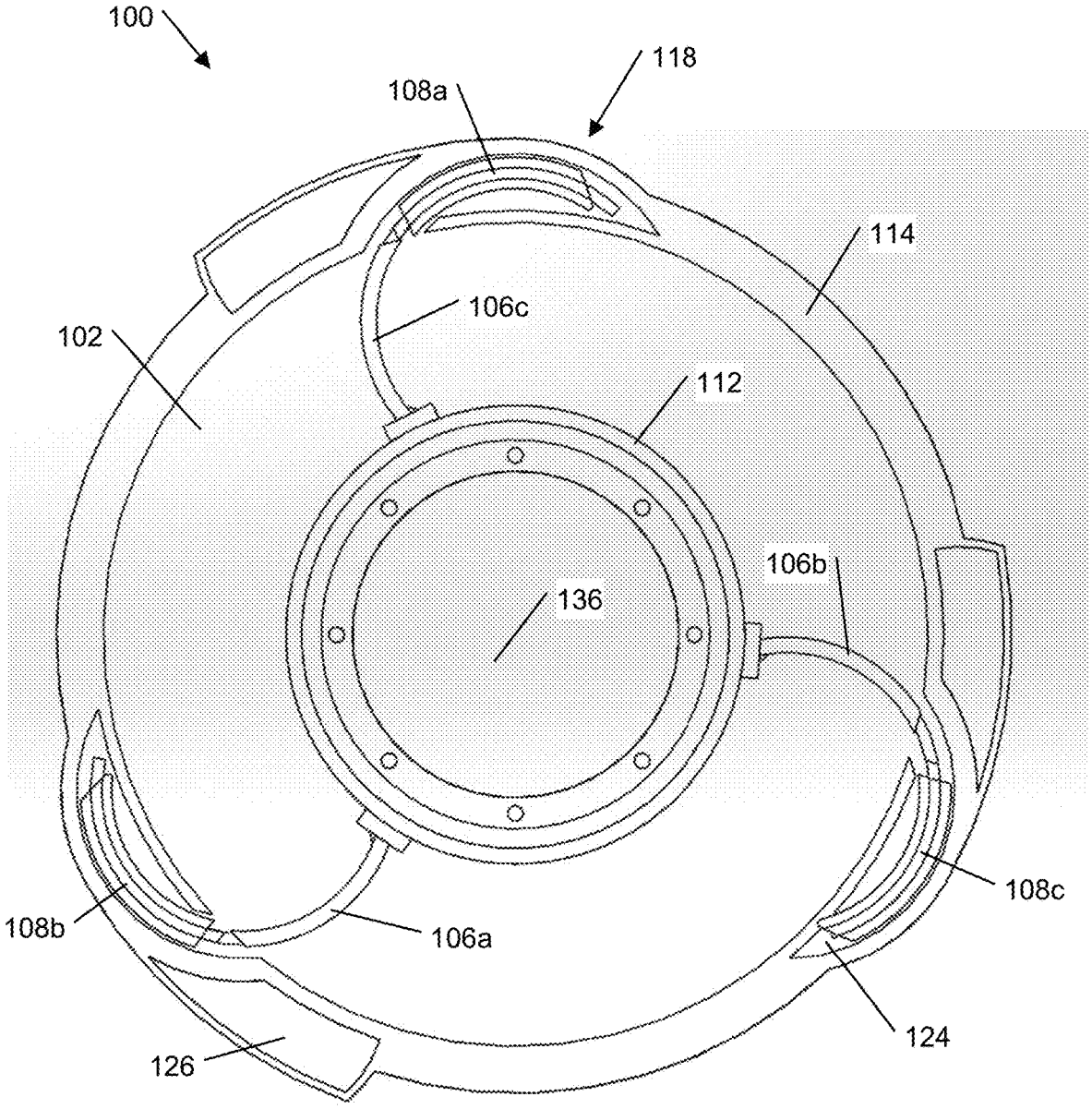
FIG. 4 is a top view of the example compressor device of FIG. 1.

The partition walls 108*a-c* are moveable between a closed position 116 (shown in FIGS. 1-3) and an open position 118 (shown in FIG. 4). When in the closed position 116, the partition walls 108*a-c* create the compression chambers 144 within the annular chamber 102, closing the distance between the inner wall 112 and the outer wall 114 of the annular chamber 102. The extension of the partition walls 108*a-c* along the entire height of the annular chamber 102 ensure that the compression chambers 144 are fully enclosed.

The partition walls 108*a-c* may, like blades 106*a-c*, have a seal along the outer edges of the partition walls 108*a-c* where the edges meet the inner wall 112 and the outer wall 114 of the annular chamber. When in the closed position 116, the seal of the partition walls 108*a-c* may ensure that the compression chamber 144 remains air-tight and does not allow any air leakage.

The compressor 100 may include, as shown in FIG. 1, a partition chamber 124 for each partition wall 108*a-c*. The partition chamber 124 may be located along the outer wall 114 of the annular chamber 102 and may be designed to receive the partition wall 108*a-c* when the partition wall 108*a-c* is moved from the closed position 116 to the open position 118.

When the partition wall 108*a-c* is in the open position 118, the partition walls 108*a-c* may be moved from within the annular chamber 102 to within the partition chamber 124. This may open the distance between the inner wall 112 and the outer wall 114 of the annular chamber 102, allowing the blades 106 to pass through.

The compressor 100 may also include an outlet chamber 126. The outlet chamber 126 may be located along the outer wall 114 of the annular chamber 102 and beside the partition chamber 124. The outlet chamber 126 may be designed to receive air from within the annular chamber 102 and direct the flow outside of the compressor 100. In some embodiments, the outlet chamber 126 may direct the flow of air along the outer wall 114 of the annular chamber 104 to the base of the compressor 100. In such instances, there may be multiple outlet chambers 126 of the compressor. For example, in some embodiments, there may be as many outlet chambers 126 as there are compression chambers 144. The outlet chambers 126 may each direct the airflow to a single outlet within the compressor 110, the outlet being in fluid communication with the surrounding environment. In some cases, the outlet chambers 126 may each direct the airflow to the base of the compressor 100 to the single outlet.

In the illustrated embodiment, the inner wall 112 contains an inlet port 104 between each partition wall 108*a-c*. The inlet port 104 is configured to bring air in from the surrounding environment to each compression chamber 144 within the annular chamber 102.

In another example, the inlet ports 104 may be located along the outer wall 114. In another example, the inlet ports 104 may be located on either the top wall 146 or the bottom wall 148 (shown in FIGS. 8 and 9) of the annular chamber 102.

In various embodiments, the compressor 100 contains an outlet port 110 configured to release the air from within the annular chamber 102. In some cases, the outlet port 110 may be located between the partition chamber 124 and the outlet chamber 126. In some other cases, the outlet port 110 may be located along the outer wall 114 of the annular chamber 102. In another example, the outlet port 110 may be located along the inner wall 112. In a further example, the outlet port may be located on either the top wall 146 or the bottom wall 148 of the annular chamber 102.

In some cases, the compressor 100 may only have one outlet port 110. In some other cases, the compressor 100 may have more than one outlet ports 110.

The compressor 100 may be constructed of any metal or polymer able to maintain a rigid profile under stress with negligible deformation. In some embodiments, the compressor 100 may be constructed of metal parts, such as steel or aluminum, for example. In some embodiments, the compressor 100 may be constructed of a polymer, such as polyethylene terephthalate glycol or polyetherimide, for example.

Figure 2:
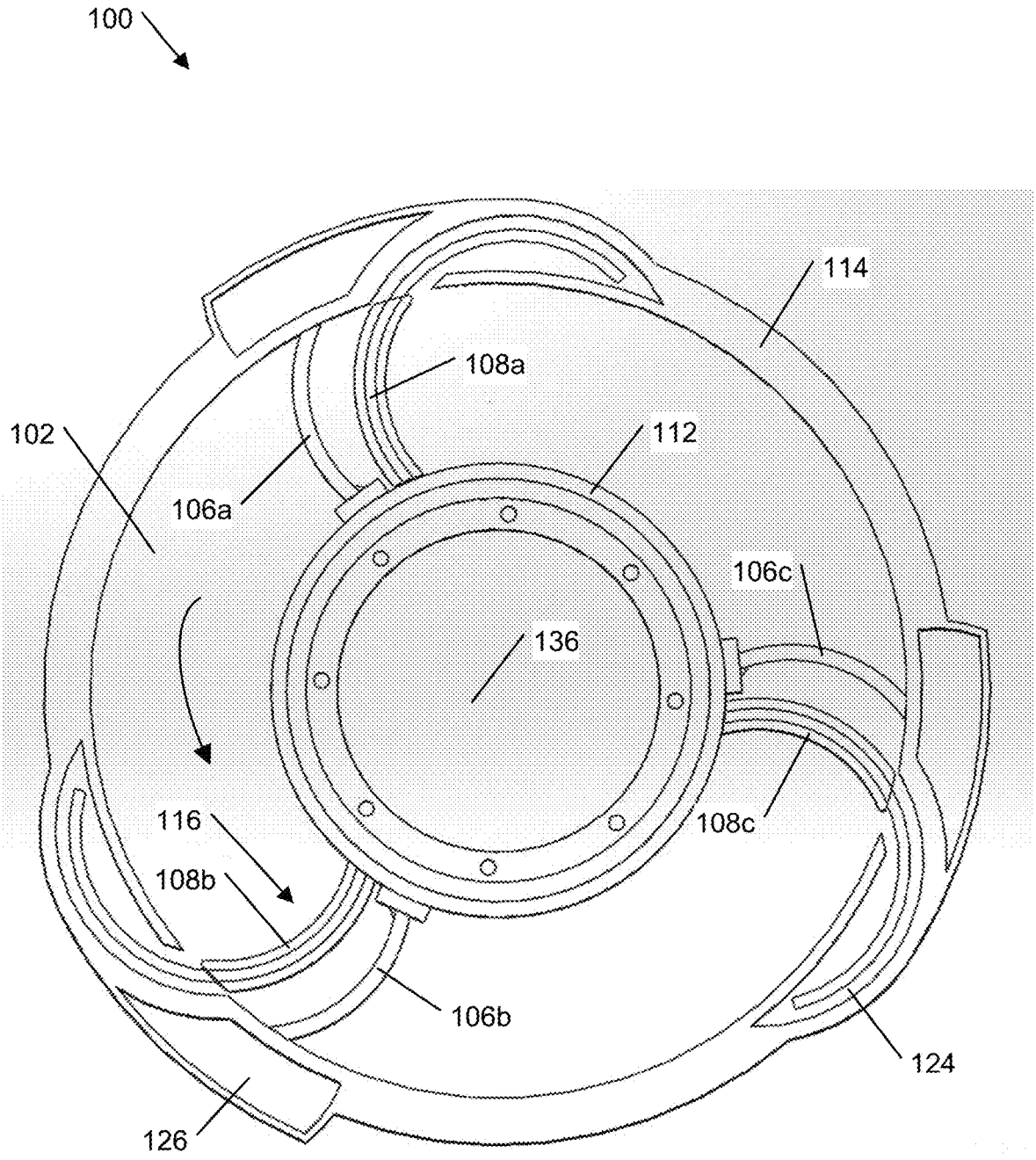
FIG. 2 is a top view of the example compressor device of FIG. 1.

Referring now to FIG. 2, shown therein is the compressor 100 at a first stage of the compression cycle, where the blades 106*a-c* are located within a compression chamber of the annular chamber 102 near the partition walls 108*a-c*.

For exemplary purposes, the blades 106*a-c* are moving around the annular chamber 102 in a counterclockwise direction. To illustrate the method and compression of the compressor 100, blade 106*a* will be followed through the compression cycle.

At the first stage, air is received into the annular chamber 102 through the inlet port 104 of the compressor 100. Air enters via the inlet port 104 into each compression chamber 144 of the annular chamber 102, filling the space between the blade 106*a* and partition wall 108*b*. Partition wall 108*b* is in the closed position 116, as illustrated.

Blade 106*a* moves in a continuous motion in the counterclockwise direction around the annular chamber 102 towards partition walls 108*b*, compressing the air from inlet port 104 between blade 106*a* and partition wall 108*b*.

Referring now to FIG. 3, blade 106*a* has moved through the annular chamber 102 towards a first side 120 of partition wall 108*b*, which remains in the closed position 116. Blade 106*a* applies pressure on the air within annular chamber 102 trapped between blade 106*a* and partition wall 108*b*. The compressed air is then pushed from the annular chamber 102 out the outlet port 110.

As blade 106*a* moves along the annular chamber 102, a suction force is created between blade 106*a* and partition wall 108*a*, as space is formed between the blade 106*a* and the partition wall 108*a*. When the suction force is created, fresh air from outside the compressor 100 is pulled through the inlet port 104 via the suction force and fills the space between the blade 106*a* and the partition wall 108*a* in the annular chamber 102. The air that has filled that space is then used in the second stage of the compression cycle for compression by blade 106*c*.

When blade 106*a* reaches within a predetermined degree and/or angular distance from the partition wall 108*b*, partition wall 108*b* is moved from the closed position 116 to the open position 118, allowing blade 106*a* to move from the first side 120 of the partition wall 108*b* to the second side 122 of the partition wall 108*b*.

In some cases, the predetermined distance may be an offset of 10 degrees between the blade 106*a* and the partition wall 108*b*. In some other cases, the predetermined degree may be around 5 degrees. In some further cases, the predetermined degree may be less than 5 degrees.

The compression cycle ends when the partition walls 108*a-c* move from the closed position 116 to the open position 118, opening the previously air-tight seal in the annular chamber 102. When the partition walls 108*a-c* move, the blades 106*a-c* are no longer able to compress the air within the annular chamber 102. As such, it is advantageous to have the predetermined degree or distance be smaller, to ensure a longer compression cycle and therefore creating the most efficient compression.

Referring now to FIG. 4, the compression cycle is completed. The partition wall 108*b* is moved into the open position 118 and blade 106*a* is in the process of moving from the first side 120 to the second side 122 of the partition wall 108*b*.

In the illustrated embodiment, the partition wall 108*b* has moved from the annular chamber 102 into the partition chamber 124 to allow the blade 106*a* to pass from the first side 120 of the partition wall 108*b* to the second side 122 of the partition wall 108*b*.

Figure 5:
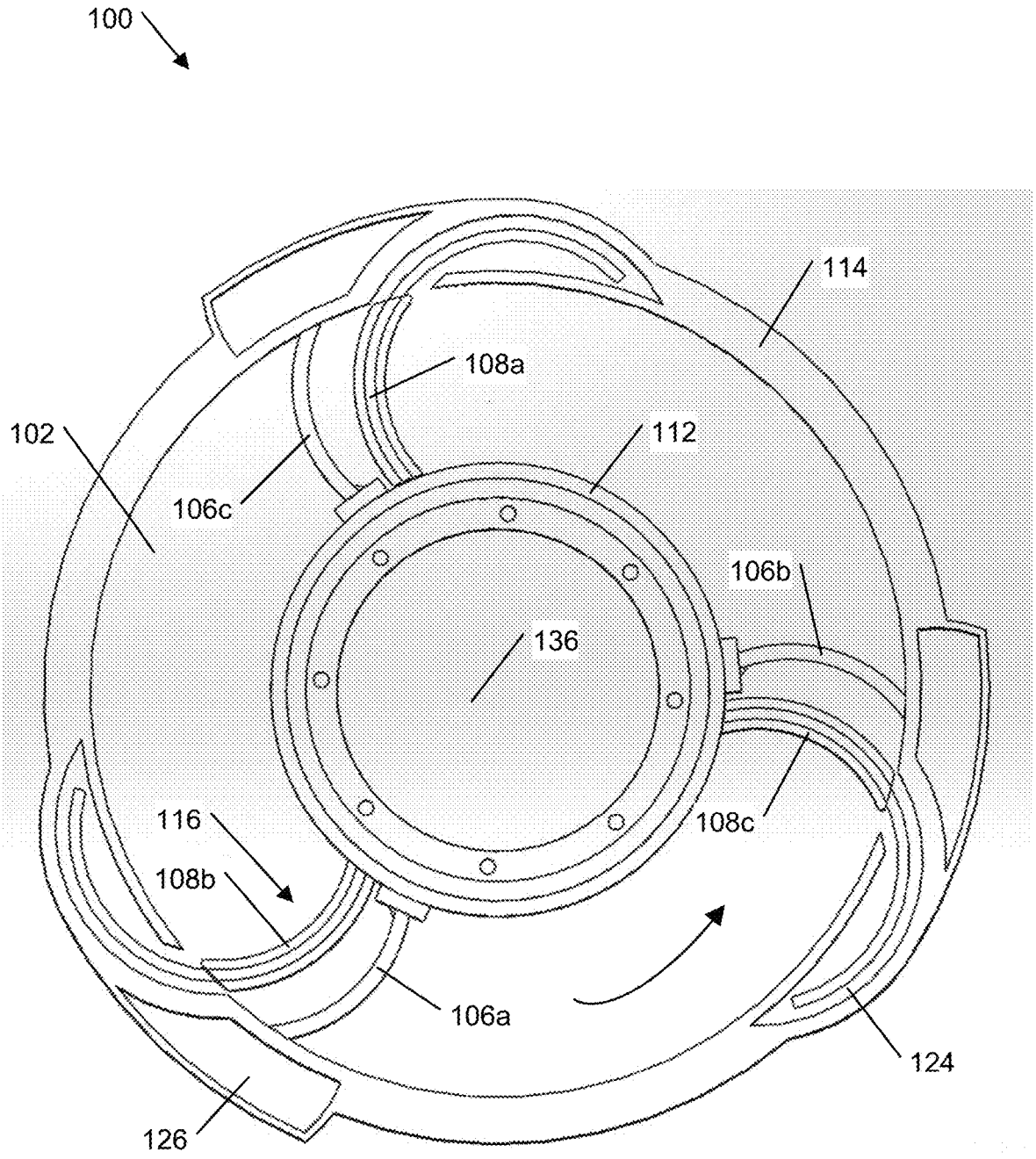
FIG. 5 is a top view of the example compressor device of FIG. 1.

In some embodiments, the partition wall 108*b* may transition from the closed position 116 to an open position 118 by vertical movement. The open position 118 of the partition wall 108*b* may be a position vertically higher than the closed position 116. This may allow the blade 106*a* to pass from the first side 120 of the partition wall 108*b* to the second side 122 of the partition wall 108*b* by moving underneath the raised partition wall 108*b*. [64] Referring now to FIG. 5, the compression cycle restarts, and the blades 106*a-c* continue to move around the annular chamber 102 compressing the air from the inlet ports 104. As shown, blade 106*a* is moving from the second side 122 of partition wall 108*b* towards the first side of partition wall 108*c*.

Figure 6:
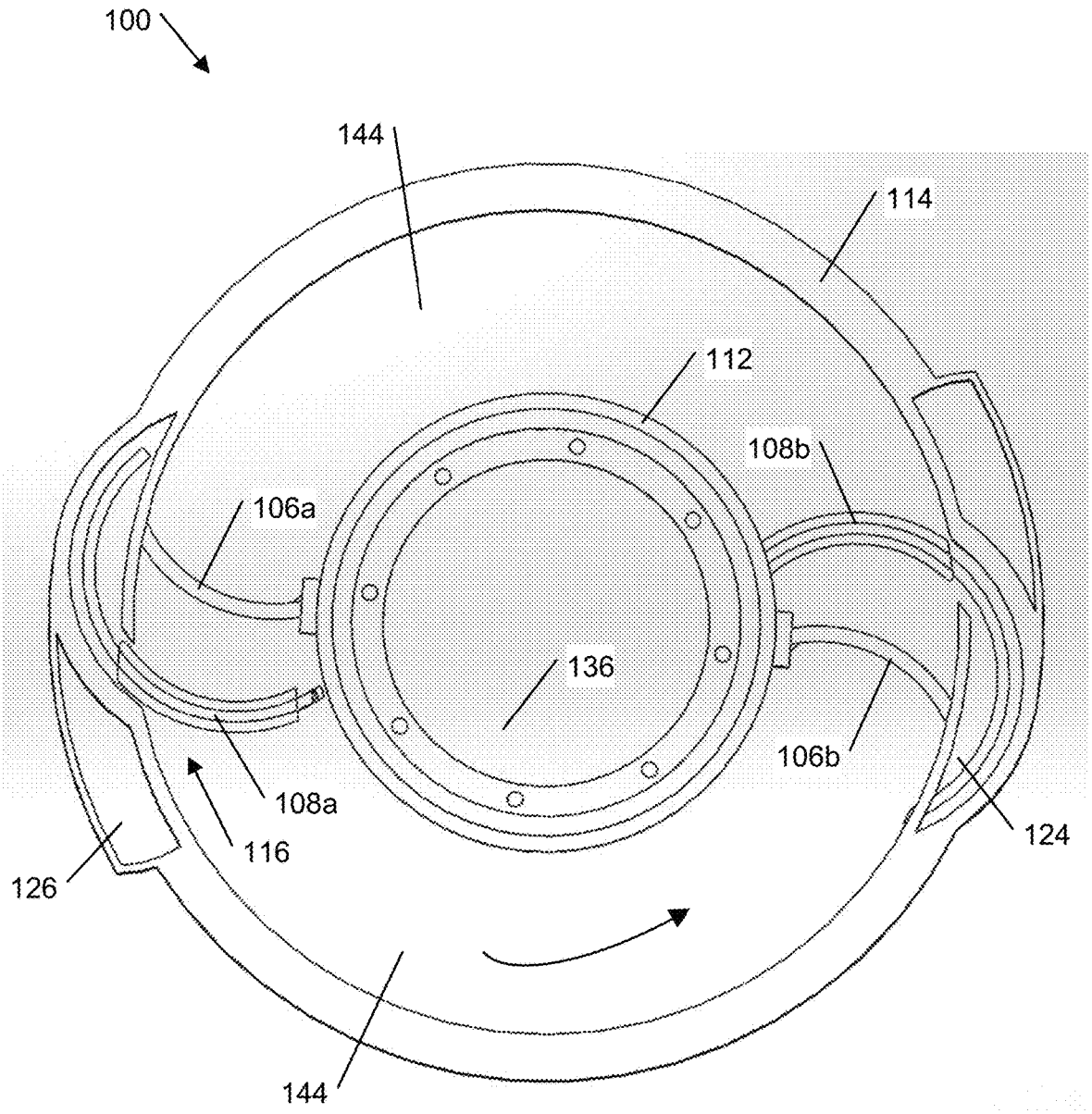
FIG. 6 is a top view of another example embodiment of a compressor device.

Referring now to FIG. 6, shown therein is an example embodiment of a compressor 100 having two blades 106*a-b* and two partition walls 108*a-b*. The two partition walls 108*a-b* form two compression chambers 144 when in the closed position 116, as illustrated.

Figure 7:
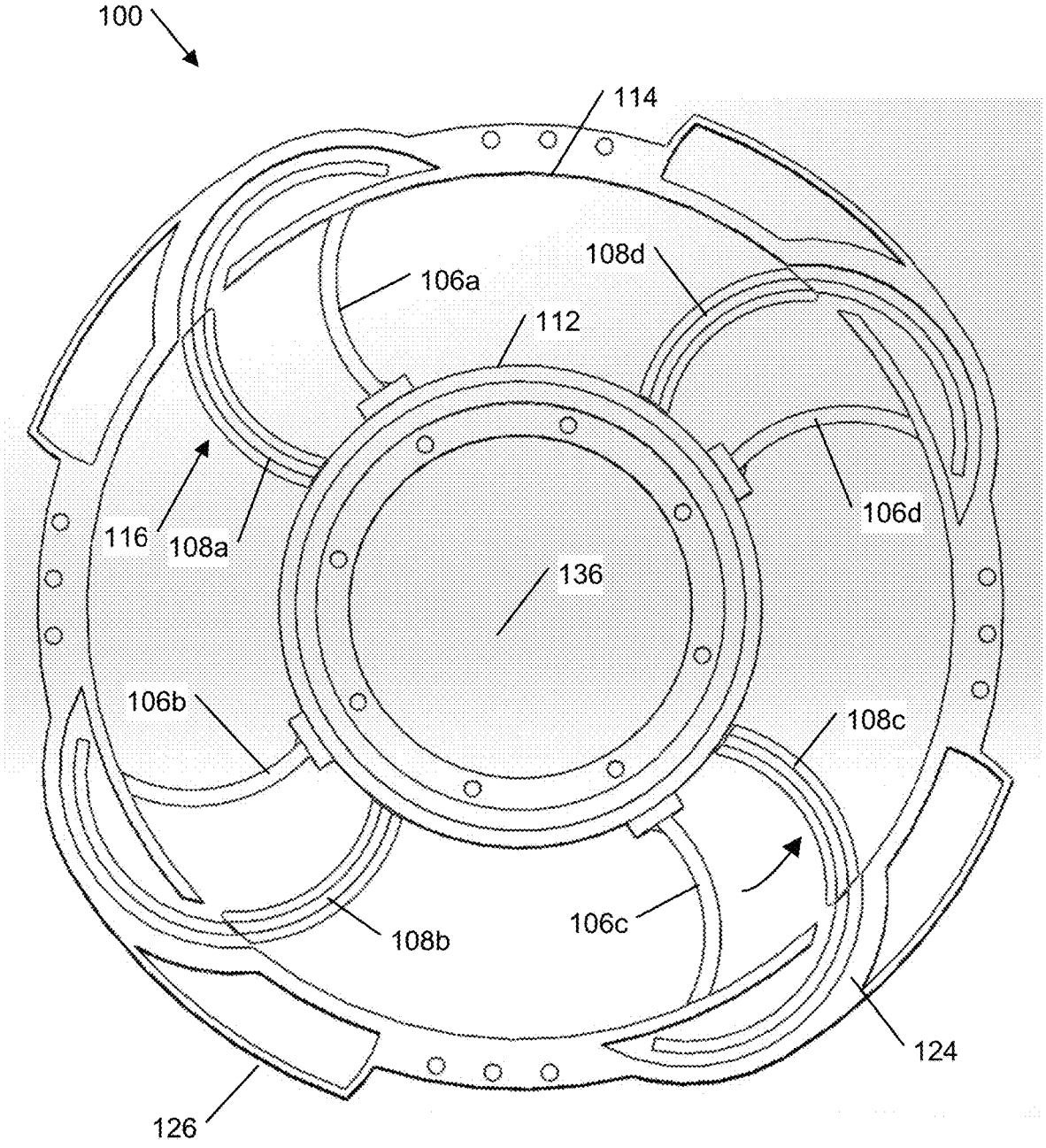
FIG. 7 is a top view of another example embodiment of a compressor device.

Referring now to FIG. 7, shown therein is an example embodiment of a compressor 100 having four blades 106*a-d* and four partition walls 106*a-d*. The four partition walls 108*a-d* form four compression chambers 144 within the annular chamber 102 when in the closed position 116, as illustrated.

The compressor 100 may be designed to have any number of blades 106, partition walls 108, and resulting compression chambers 144. However, in each design, the compressor 100 must have an equal number of blades 106, partition walls 108, inlets 104, and outlets 110.

Figure 8:
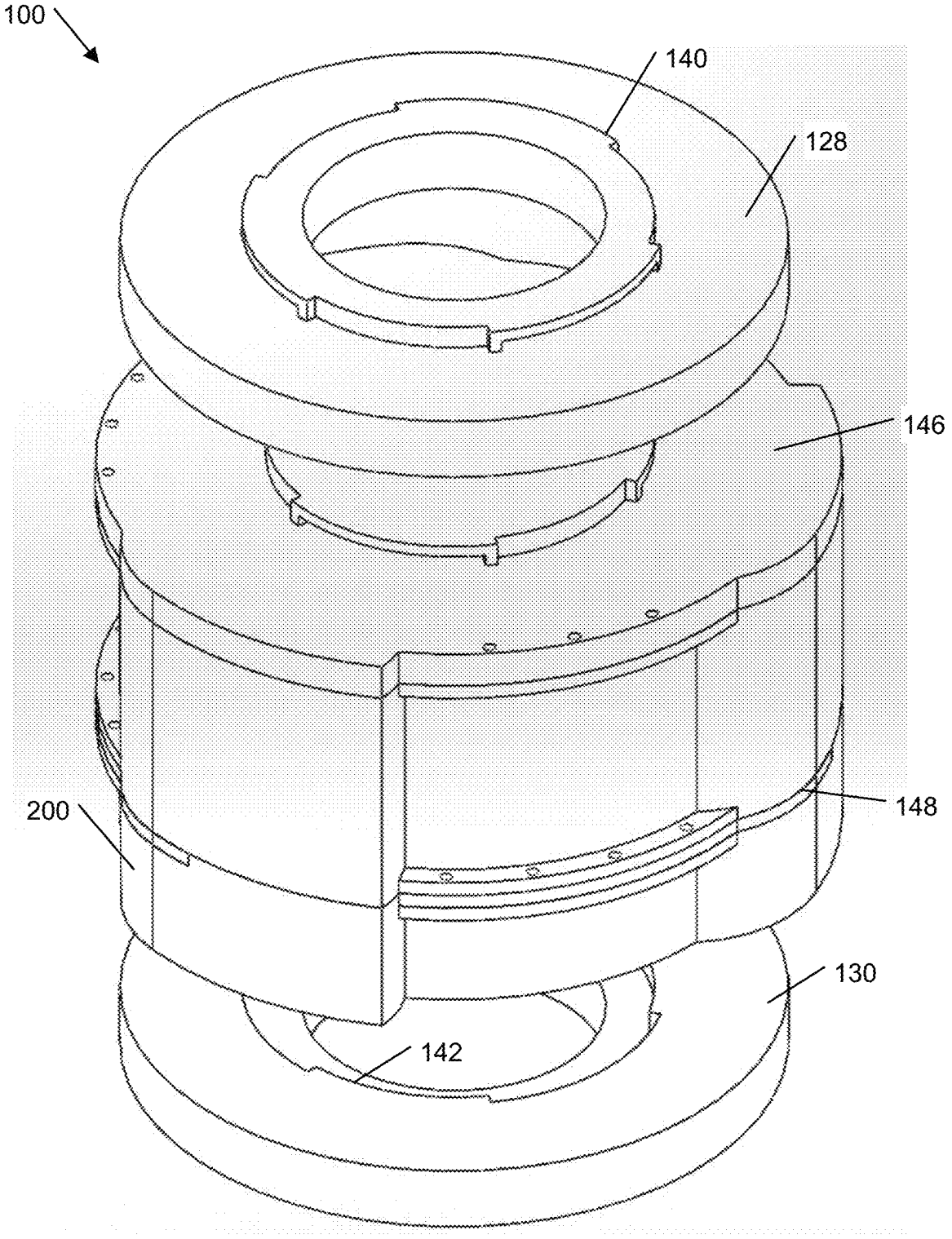
FIG. 8 is an exploded perspective view of an example embodiment of a compressor device.

Referring now to FIG. 8 shown therein is an example embodiment of a compressor 100 having a top module 128 and a bottom module 130. The top module 128 may be configured to treat the air prior to the air reaching the annular chamber 102 of the compressor 100. The bottom module 130 may be configured to treat the air after the air has been compressed within the annular chamber 102 of the compressor 100.

Additional air treatment components, such as, for example, a heater, a filter, an oxygen scrubber, etc., may be integrated into the system within the top module 128 or the bottom module 130.

The top module 128 may contain a module inlet 140 that acts in the same fashion as the inlet port 104 of the compressor 100, where the incoming air from the surrounding environment is drawn into the module inlet 140. The air flow may pass into the module inlet 140, through the top module 128 which may treat and/or filter the air, and into the compressor 100 for compression.

The bottom module 130 may contain a module outlet 142 that acts in the same fashion as the outlet port 110 of the compressor 100, where the outgoing compressed air is directed out of the compressor 100 through the module outlet 142. The air flow may pass through the compressor 100, into and through the bottom module 130 which may treat and/or filter the air, and out of the system.

Figure 9:
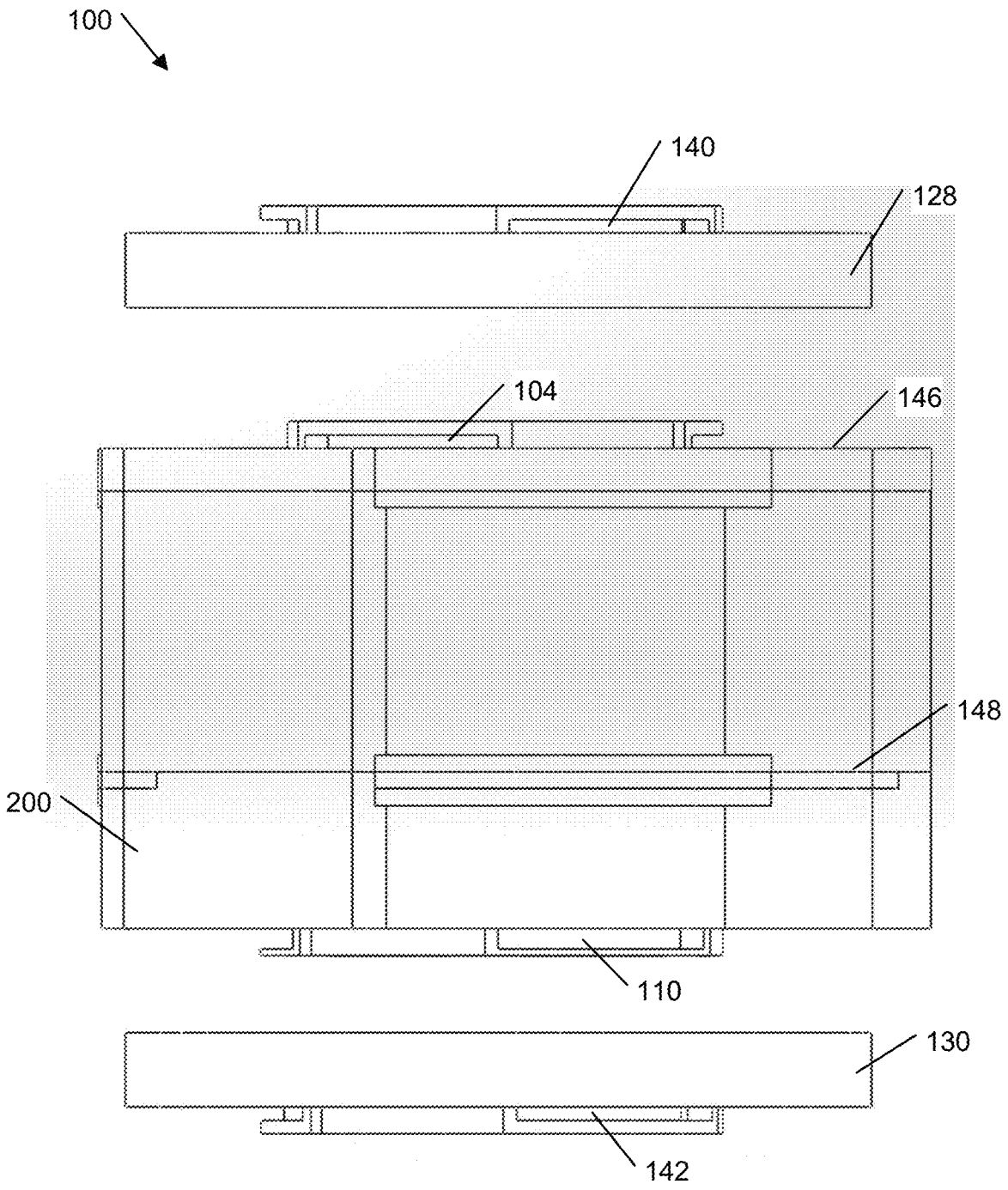
FIG. 9 is a side view of the example compressor device of FIG. 8.

Referring now to FIG. 9, shown is a side view of the compressor 100 of FIG. 8 illustrated with both the top module 128 and bottom module 130, in some embodiments, the compressor 100 only contains a top module 128. In some other embodiments, the compressor 100 only contains the bottom module 128.

In various cases, multiple top modules 128 and/or bottom modules 130 may be attached to the compressor 100 to complete the desired air filtering and/or treatment of the air prior to or after compression. Any combination of top modules 128 and bottom modules 130 may be added. The airflow reaching the compressor may not be affected by the additional top modules 128. In some embodiments, a motor with increased power may be used to create an increased suction force by the blades 106 to enable the air to be pulled through the top modules 128.

Figure 10:
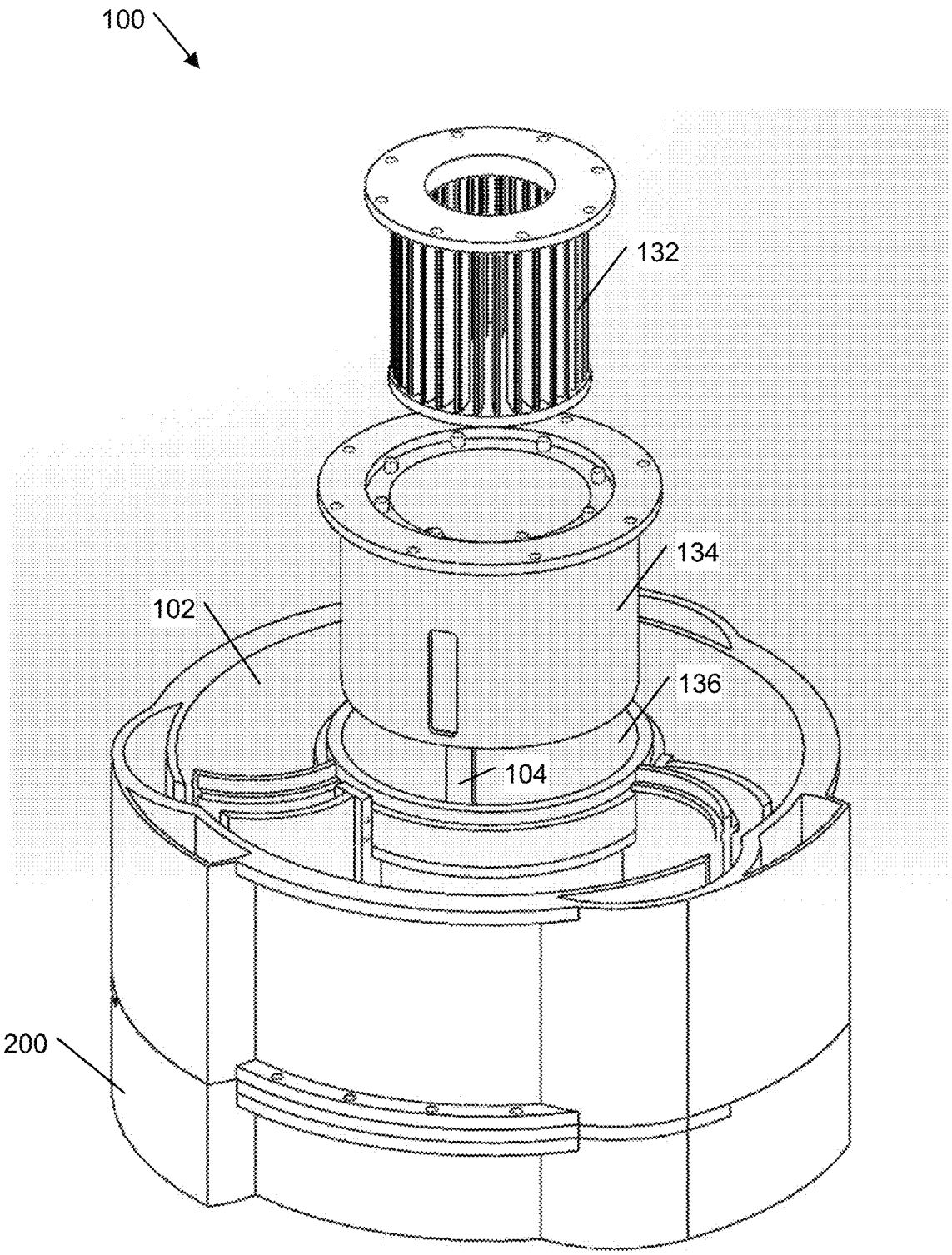
FIG. 10 is an exploded perspective view of an example embodiment of a compressor device.

Referring now to FIG. 10, shown therein is an example embodiment of a compressor 100 having additional components located within the inner chamber 136. The additional components may include, as shown in the illustrated embodiment, a filter 132 and a heater 134. In some embodiments, the additional components may include an oxygen scrubber. The additional components may be sized and shaped to be receivable within the inner chamber 136 and designed to accept radial airflow.

The inlet port 104 of the compressor 100, as noted above, may be located along the inner wall 112 of the annular chamber 102. As such, the incoming air into the annular chamber 102 may first arrive at the inner chamber 136 of the compressor 100 prior to moving radially outwards into the annular chamber 102. The inclusion of additional components within the inner chamber 136 may allow for the air to be treated prior to entering the compressor 100 through the inlet port 104. As illustrated, the air may be treated in multiple ways (such as filtering with filter 132 and heating with heater 134) before entering the annular chamber for compression.

In the illustrated embodiment, the air flow would pass through the filter 132, into the heater 134, and into the annular chamber 102 of the compressor 100.

In some embodiments, the compressor 100 may include additional components within the inner chamber 136 as well as an added top module 128 and/or bottom module 130.

Figure 11:
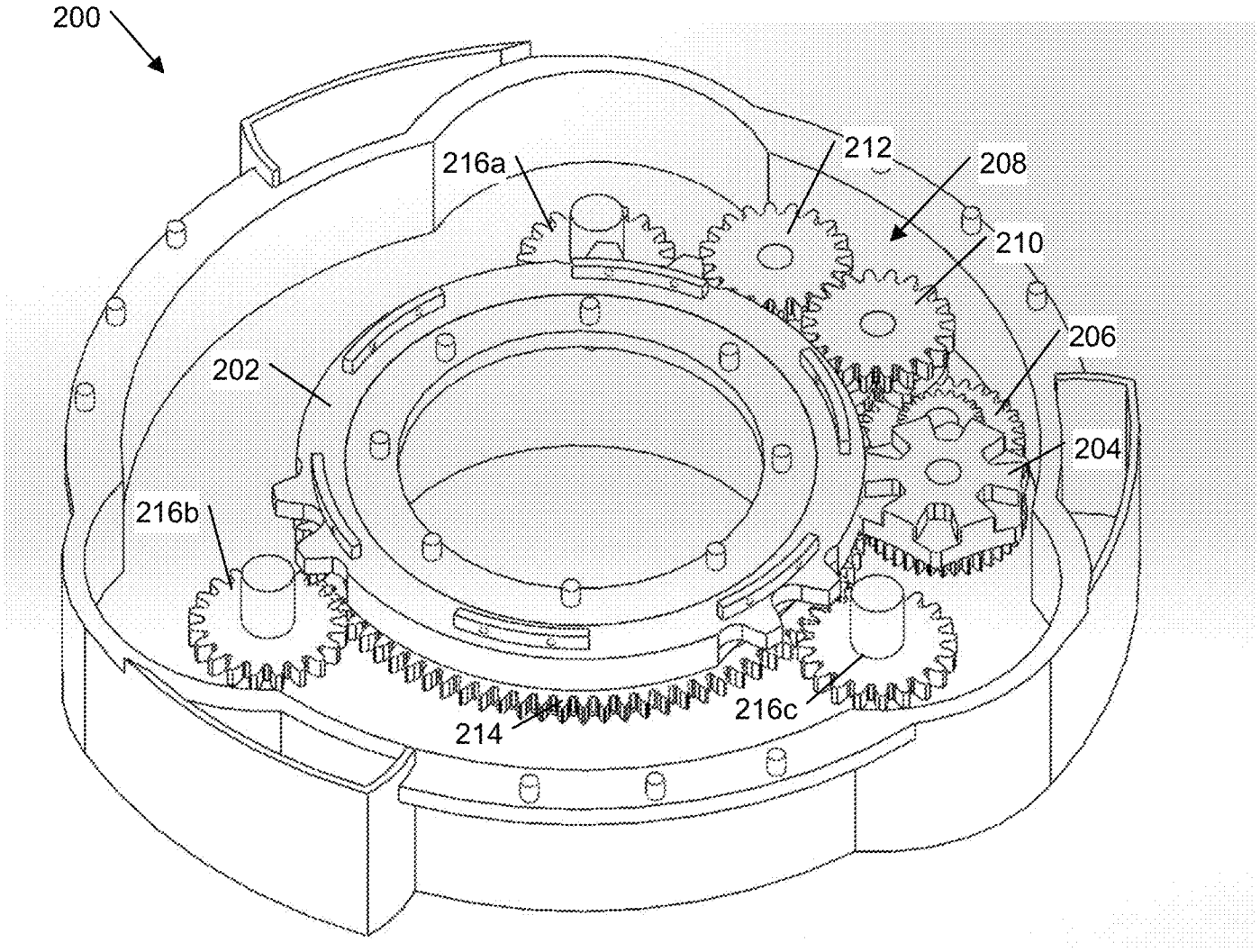
FIG. 11 is a perspective view of an example embodiment of a gearbox train.
Figure 12:
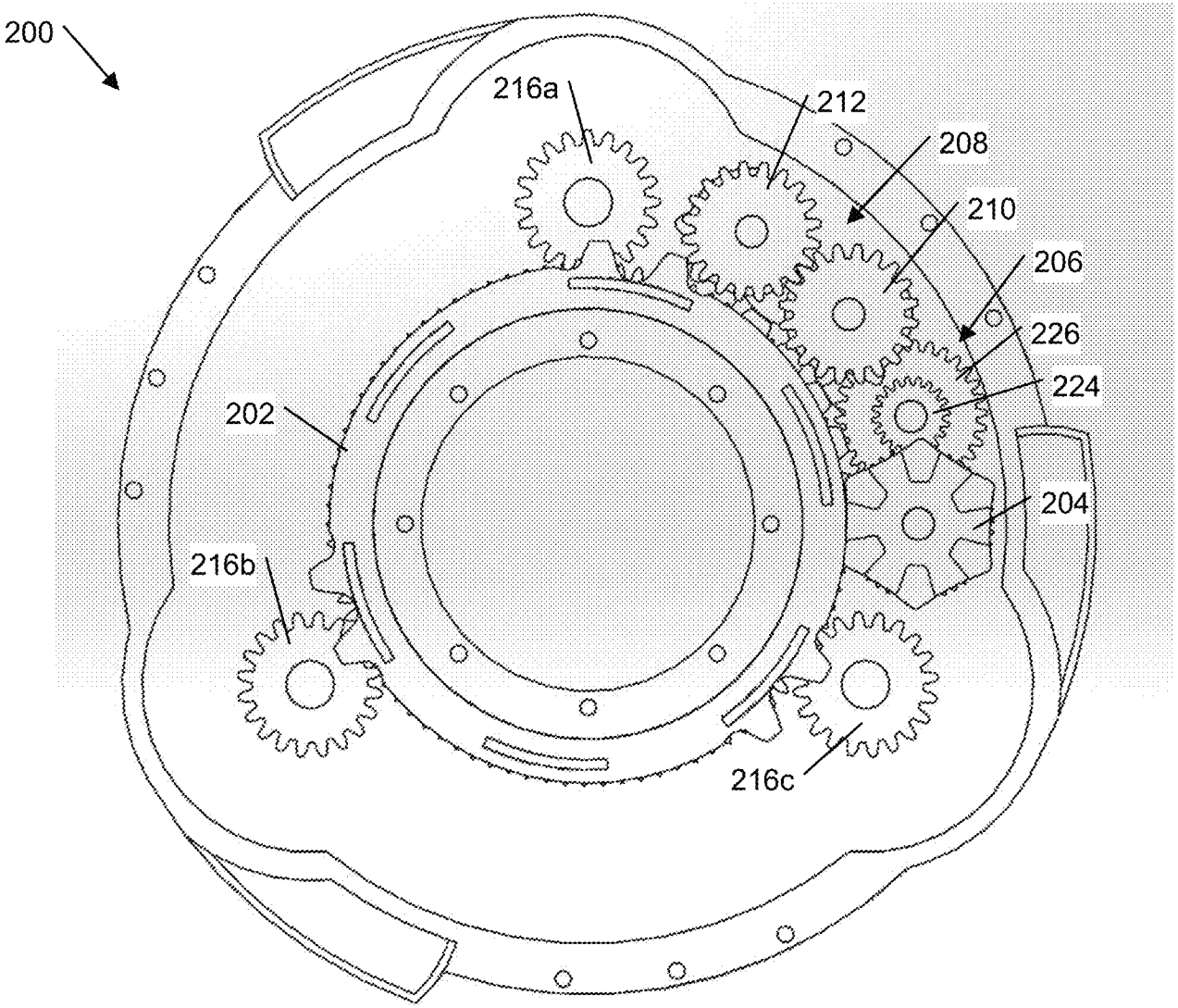
FIG. 12 is a top view of the example gearbox train of FIG. 11.

Referring now to FIGS. 11 and 12, shown therein is an example embodiment of the gearbox train 200. The gearbox train 200 may be located along the bottom portion of the compressor 100. The gearbox train 200 may be configured to connect the motion of the blades 106 with the movement of the partition walls 108 between the closed position 116 and the open position 118. In particular, the gearbox train 200 controls the movement of the partitional walls 108 between the closed 116 and the open 118 positions when the blade 106 is detected to be within a predetermined distance from the corresponding partition wall 108. As discussed above, this allows the corresponding blade to move from one side of the partition wall to the other side and restart the compression operation.

In some embodiments, a sensor and a motor may be used to control the movement of the partition walls 108, where the sensor may sense the location of the blade, and the motor may trigger the opening and closing of the partition wall based on the sensed location. However, depending on the application of the compressor 100, the use of a sensor may not be preferred. For example, if the compressor 100 is used in space or deep-sea applications, or applications where accessibility to the compressor 100 is generally limited in that compressor maintenance or fixing of the compressor 100 may be challenging, the use of a sensor may not be preferred. The use of gears may provide the advantage of longevity and stability of the compressor system, thereby ensuring smooth operation of the partition walls.

In the illustrated embodiment, the gearbox train 200 is in communication with and provides transmission for the motor designated to move the blades 106 of the compressor 100. The gearbox train 200 is designed to complete three sets of motion. The first is the conversion of continuous rotary motion into intermittent rotary motion. The second is the increase in speed of the intermittent rotary motion. The third is the conversion of the high-speed intermittent rotary motion into reciprocal motion.

The conversion of continuous rotary motion into intermittent motion may require execution of partial rotation when a gear rotation has reached a predetermined degree.

For example, in the illustrated embodiment, there are three blades 106 within the compressor 100. As such, the partial rotation may be executed at about every 120-degree rotation of the blades 106. In other embodiments, the partial rotation may be executed at any other degree rotation of the blades 106. For example, if the compressor 100 contained four blades 106, the partial rotation would be executed at about every 90-degree rotation of the blades 106. Generally, if the compressor 100 has 'n' blades or partitions, the angular distance the blades 106 have to clear for intermittent motion is 360/n degrees. In some cases, the partial rotation of the gear is triggered at a predetermined angular distance between the blade 106 and the partition wall 108. [82] The increase of rotational speed of the intermittent rotary motion may involve the inclusion of different sized gears to achieve the speed increase.

The conversion of high-speed intermittent motion to reciprocal motion causes gear rotation in a first direction and then gear rotation in a second opposing direction. In some cases, the reciprocal motion may be around 90 degrees in the first direction and around 90 degrees in the second direction. In some cases, the reciprocal motion may be around 30 degrees in the first direction and around 30 degrees in the second direction. In other cases, the reciprocal motion may be of any degree in the first and second directions.

The gearbox train 200 is designed to allow the partition walls 108 to move from the closed position 116 to the open position 118 when the blades 106 are at the predetermined angular distance from the partition walls 108.

The partition walls 108 may be designed to move at a speed greater than the rotation speed of the blades 106. For example, if the predetermined angular distance of the blade 106 from the partition wall 108 is determined to be 5 degrees, the partition wall 108 must be able to move from the closed position 116 to the open position 118 and back to the closed position 116 while the blade 106 moves a total of 10 degrees around the annular chamber. The speed of motion of the partition wall 108 in comparison to the speed of motion of the blade 106 may be accounted for by the gearbox train 200. To ensure that the speed of motion of the partition wall 108 is appropriate and implemented at the desired time, the gearbox train 200 is used to connect the movement of the blades 106 with the movement of the partition walls 108.

In the illustrated embodiment, gearbox train 200 includes a hub gear 202. The hub gear 202 may be the same circumference of the inner wall 112 of the annular chamber 102. The hub gear 202 is in communication with the blades 106 of the compressor 100 and designed to drive the blades 106 around the annular chamber 102. The hub gear 202 rotates around the gearbox train 200 at the same angular velocity as the blades 106 around the annular chamber 102.

The hub gear 202 is in communication with the motion conversion gear 204. The motion conversion gear 204 is designed to communicate with the hub gear 202 when the blades 106 are within the predetermined degree and/or angular distance from the partition walls 108.

Figure 13:
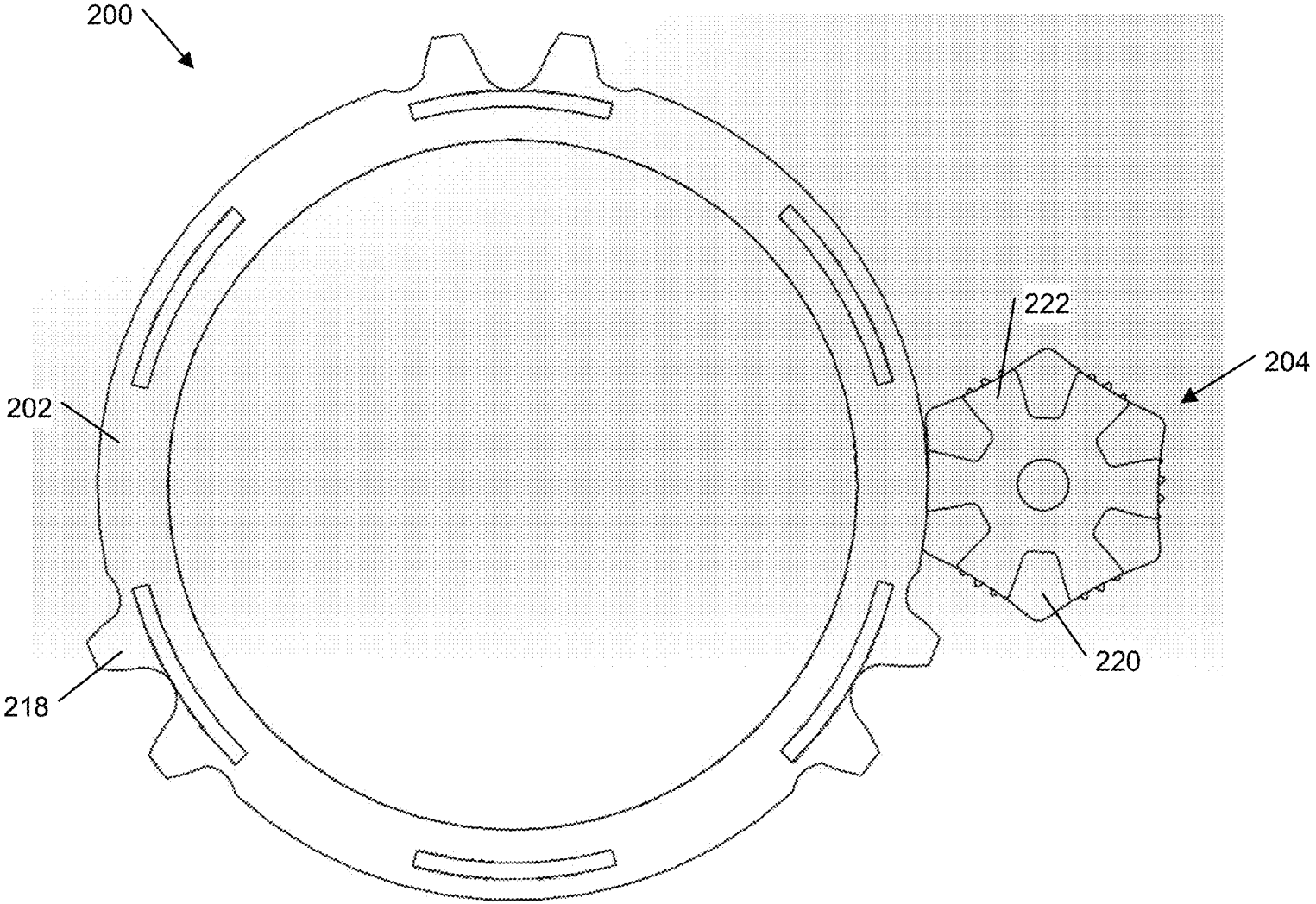
FIG. 13 is a top view of two isolated components of the example gearbox train of FIG. 11.
Figure 14:
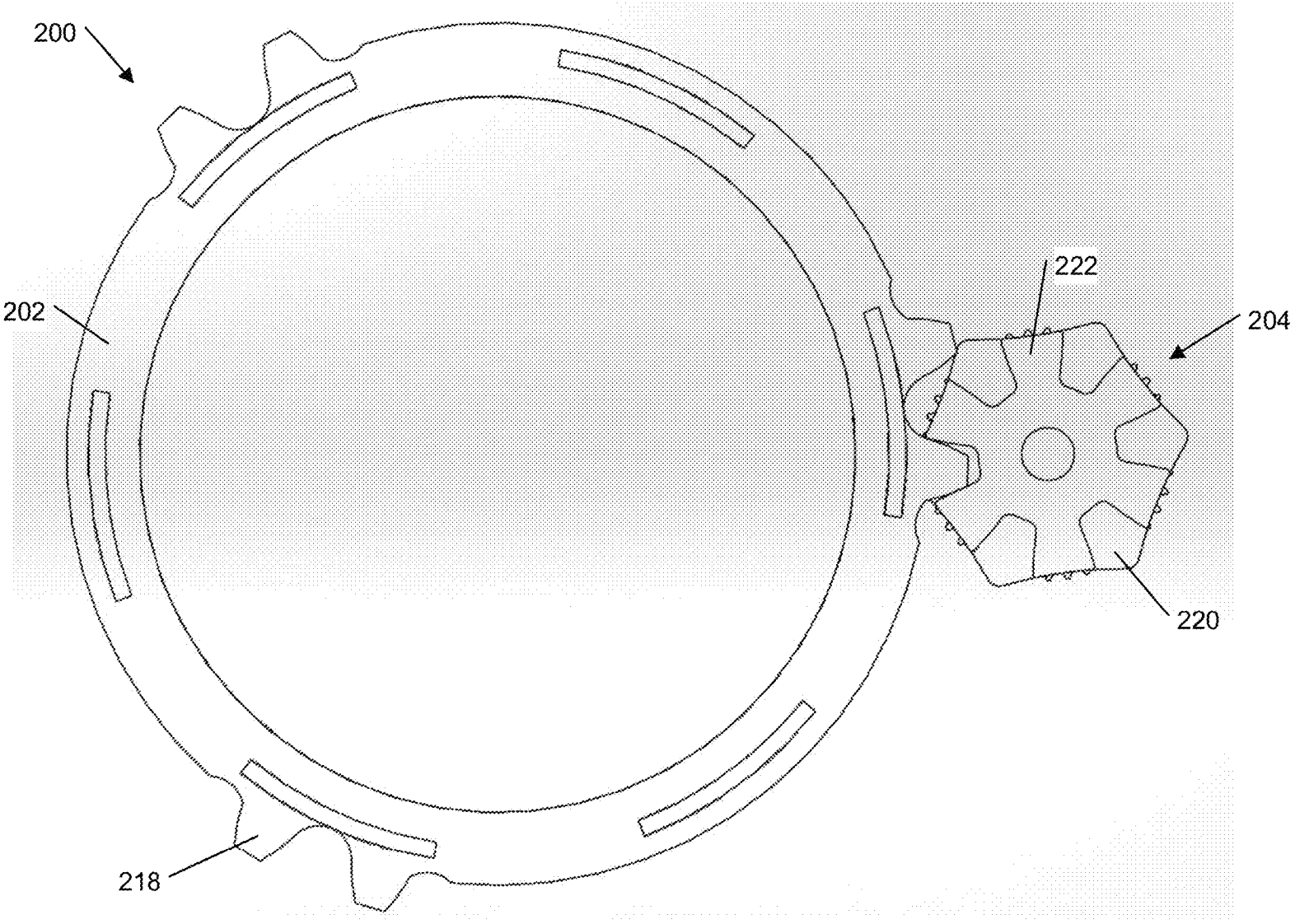
FIG. 14 is a top view of two isolated components of the example gearbox train of FIG. 11.

Referring now to FIGS. 13 and 14, shown therein are isolated views of the hub gear 202 and the motion conversion gear 204. In the illustrated embodiment, the hub gear 202 contains sets of two teeth 218. The hub gear 202 contain two teeth 218 corresponding to each blade 106 of the compressor 100. For example, the illustrated embodiment shows the hub gear 202 having three sets of two teeth 218, corresponding to the compressor 100 embodiment shown in FIG. 1, which has three blades 106*a-c*. The sets of teeth 218 are positioned equidistant.

The sets of teeth 218 of the hub gear 202 may interact with the motion conversion gear 204. The motion conversion gear 204 is designed to have two layers, a hexagonal lower layer 220 and a profiled upper layer 222.

The hexagonal lower layer 220 of the motion conversion gear 204 may have curved arcs replacing the outer edges of the hexagon. The curved arcs may match the curvature of the hub gear 202. As such, when the hub gear 202 rotates as illustrated, with the sets of teeth 218 not in contact with the motion conversion gear 204, the motion conversion gear 204 does not rotate.

The profiled upper layer 222 may have modified involute curves. The involute curves of the profiled upper layer 222 may be conjugate with the curve of the sets of teeth 218 of the hub gear 202.

The motion conversion gear 204 may be generated to be of any size, thereby allowing for changes to the thickness of the compressor 100 and the annular chamber 102.

In some embodiments, a Geneva gear or a modified Geneva gear may be used in place of the motion conversion gear 204 to convert the continual rotation of the hub gear 202 to intermittent rotation. However, potential drawbacks to these embodiments may be the set size of the Geneva mechanism. Further, the Gevena mechanism uses a pin structure, which may be a failure point in the system if the compressor 100 is used in a high stress environment. In such embodiments, it may be possible to use a stronger material to compensate for the failure point.

The motion conversion gear 204 may be designed to provide intermittent motion at increased gear size ratios and within a high stress environment. The involute curve of the motion conversion gear 204 replaces the pin of typical Geneva mechanisms, allowing for the gear to function in the high stress environment without fear of failure.

Referring now to FIG. 14, the hub gear 202 is illustrated to have rotated so that one of the sets of teeth 218 are in contact with the profiled upper layer 222 of the motion conversion gear 204.

The interaction of the hub gear 202 with the motion conversion gear 204 may only occur when the sets of teeth 218 contact the profiled upper layer 222 of the motion conversion gear 204. At all other points of rotation of the hub gear, the motion conversion gear 204 may remain stationary. As such, the continual motion of the hub gear 202 is translated into intermittent motion of the motion conversion gear 204.

In some embodiments, the hub gear 202 may contain a cut-out below each set of teeth 218 to allow for the hexagonal lower layer 220 of the motion conversion gear 204 to rotate unimpeded.

The conversion of the continual motion of the hub gear 202 into intermittent motion of the motion conversion gear 204 may further include a rotation speed increase. As the motion conversion gear 204 is of a smaller size than the hub gear 202, the motion conversion gear 204 may rotate at a speed corresponding to the size difference. For example, in the illustrated embodiment, the motion conversion gear 204 is $\frac{1}{3}^{rd}$ the size of the hub gear 202. The rotational speed of the motion conversion gear 204 may be 3 times the rotational speed of the hub gear 202.

The rotation speed increase of the motion conversion gear 204 may be beneficial to increasing the speed of rotation for the remaining gears in the gearbox train 200, which in turn, increases the rotational speed of the partition walls 108 of the compressor 100.

In some embodiments, the motion conversion gear 204 may have a traditional spur gear located directly below the motion conversion gear 204 for communication with other gears in the gearbox train 200.

Referring back to FIGS. 11 and 12, the motion conversion gear 204 is in communication with a speed amplification gear 206. The speed amplification gear 206 may be implemented to increase the speed of rotation of the intermittent motion of the motion conversion gear 204.

The speed amplification gear 206 may be in contact with the traditional spur gear located below the motion conversion gear 204.

The speed amplification gear 206 may be comprised of two spur gears, a top spur gear 224 of smaller circumference in communication with a bottom spur gear 226 of larger circumference. The motion conversion gear 204 may be in communication with the top spur gear 224. As the motion conversion gear 204 contacts and rotates the top spur gear 224, the bottom spur gear 226 rotates in synchronicity with the top spur gear 224.

The use of the traditional spur gear below the motion conversion gear 204, and use of a top and bottom spur gears 224, 226 in the speed amplification gear 206 has the effect to increasing the speed of the motion conversion gear 204 by a certain factor. For example, this may gear assembly may increase the speed of the motion conversion gear 204 by a factor of 2.

In some embodiments, two or more gears may be used to increase the speed of the intermittent motion, in place of the singular speed amplification gear 206.

Next, the speed amplification gear 206 is in communication with the reciprocal gear system 208. As shown, the reciprocal gear system 208 includes two gears: a first reciprocal gear 210 and a second reciprocal gear 212.

Figure 15:
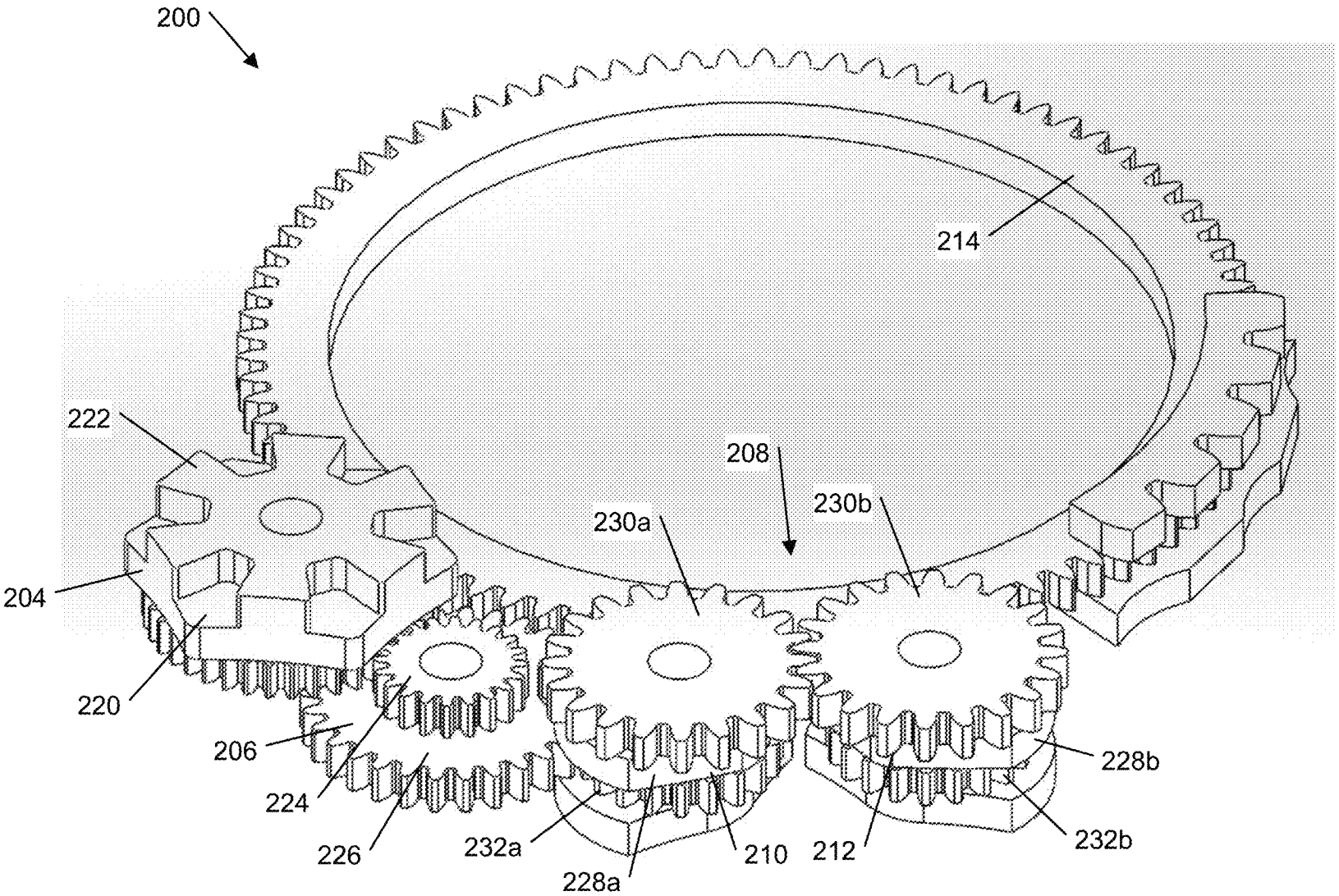
FIG. 15 is a perspective view of the example gearbox train of FIG. 11.

Referring now to FIG. 15, shown therein is an example embodiment of the gearbox train 200. As shown, the first reciprocal gear 210 is in communication with the speed amplification gear 206, and the second reciprocal gear 212 is in communication with the first reciprocal gear 210. The first reciprocal gear 210 and the second reciprocal gear 212 are configured to rotate in opposing directions.

For example, the speed amplification gear 206 may be rotating in a first direction. When the speed amplification gear 206 contacts the first reciprocal gear 210, the first reciprocal gear 210 may rotate in a second direction. The first reciprocal gear 210 then may contact the second reciprocal gear 212, causing a rotation of the second reciprocal gear 212 in the opposite direction to the first reciprocal gear 210, i.e. in the first direction.

In some embodiments, the first reciprocal gear 210 may rotate 90 degrees in the first direction when the speed amplification gear 206 is translating motion to the first reciprocal gear 210. In said embodiment, the second reciprocal gear 212 will then rotate 90 degrees in the second direction when the first reciprocal gear 210 is translating motion to the second reciprocal gear 212.

The first reciprocal gear 210 and the second reciprocal gear 212 are each in communication with the central spur gear 214.

In some embodiments, the reciprocal gear system 208 as disclosed herein may be replaced by a standard reciprocal gear system, such as a rapid acting Geneva gear or a reciprocating Geneva gear. The reciprocal motion resulting from the standard reciprocal gear systems may directly contact the central spur gear 214.

Figure 16:
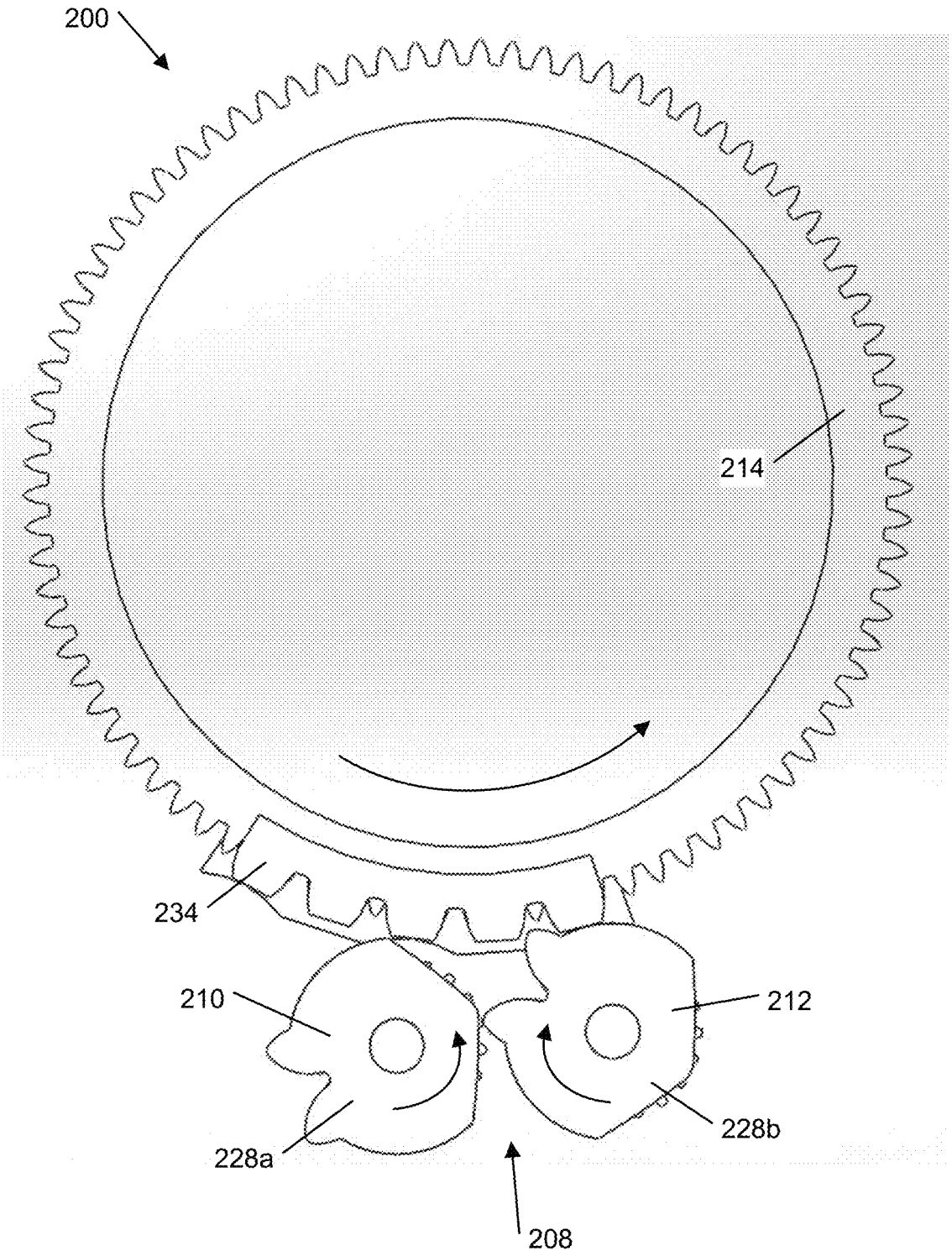
FIG. 16 is a top view of three isolated components of the example gearbox train of FIG. 11.

Referring now to FIG. 16, shown is a view of the reciprocal gear system 208 in communication with the central spur gear 214.

The first and second reciprocal gears 210, 212 each may be comprised of a main section 228*a-b*, a top section 230*a-b*, and a bottom section 232*a-b*. The bottom section 232*a* of the first reciprocal gear 210 may be in contact with the bottom spur gear 226 of the speed amplification gear 206. The top section 230*a-b* of each the first and second reciprocal gears 210, 212 may be in contact with one another to translate the rotation of the first reciprocal gear 210 in the first direction to rotation in the opposite direction of the second reciprocal gear 212.

The main sections 228*a-b* of each of the first and second reciprocal gears 210, 212 may have two exaggerated gear teeth, as illustrated in FIG. 16. Each main section 228*a-b* may contain a cut shape on the opposing side of the gear teeth to allow the opposing reciprocal gear to rotate unimpeded. The gear teeth of the main sections 228*a-b* are designed to rotate the central spur gear 214.

As illustrated in FIG. 16, rotation of main section 228*b* of the second reciprocal gear 212 in the clockwise direction may initiate contact between the gear teeth of main section 228*b* with the central spur gear 214, causing the central spur gear 214 to rotate in the counterclockwise direction. The movement of the central spur gear 214 may be limited to around 30 degrees in the second direction, as the gear teeth of the second reciprocal gear 212 may no longer contact the central spur gear 214 after the degree of rotation of the central spur gear 214 has completed.

Figure 17:
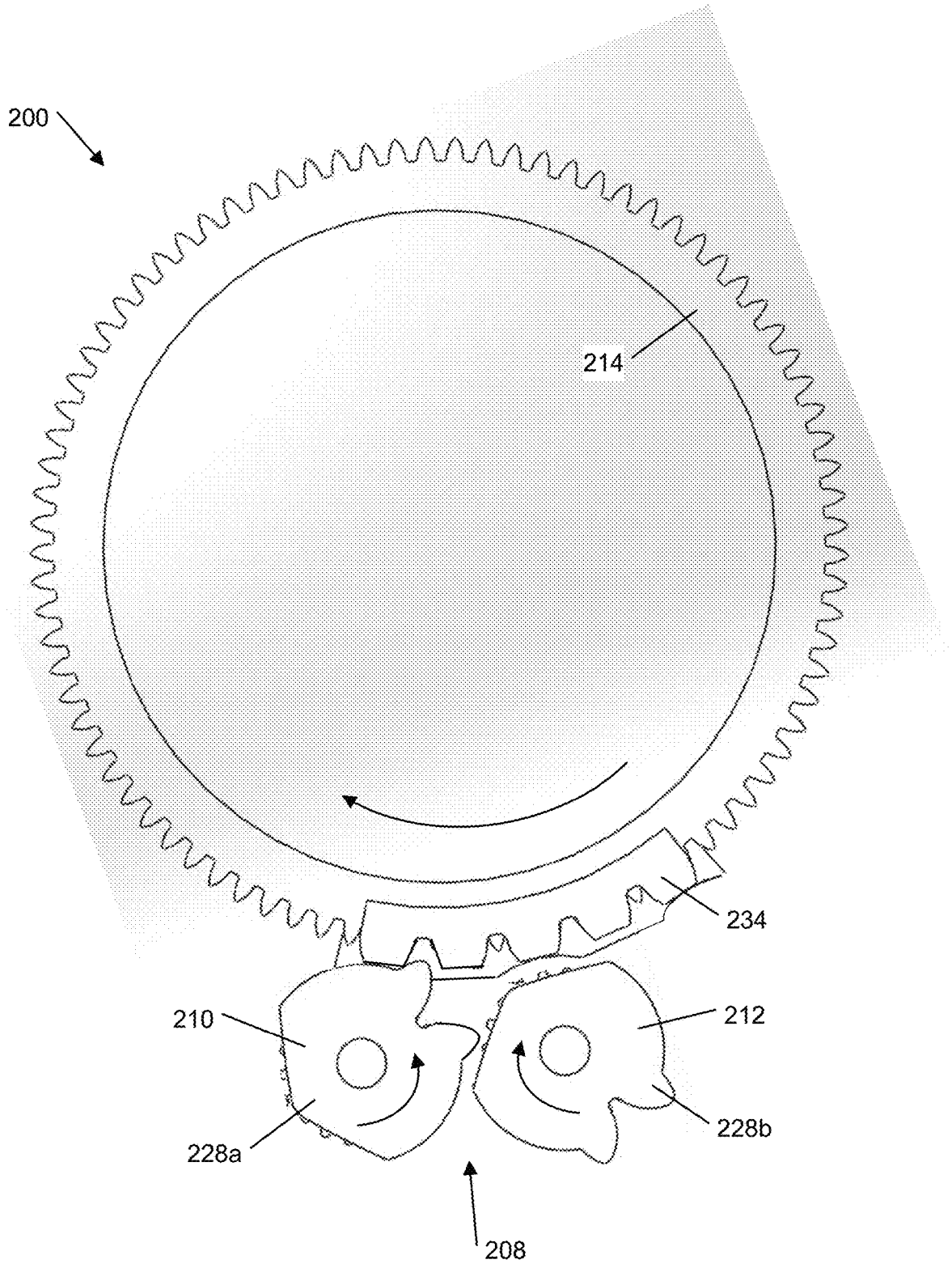
FIG. 17 is a top view of three isolated components of the example gearbox train of FIG. 11.

After rotation of the central spur gear 214 in the counterclockwise direction, the first reciprocal gear 210 may contact the central spur gear 214 to initiate rotation in the clockwise direction. As shown in FIG. 17, the gear teeth of main section 228*a* of the first reciprocal gear 210 contact the central spur gear 214 to cause rotation of the central spur gear 214 in the clockwise direction. The movement of the central spur gear 214 may be limited to around 30 degrees in this direction, as the gear teeth of the first reciprocal gear 210 may no longer contact the central spur gear 214 after the degree of rotation of the central spur gear 214 has completed.

The communication between the reciprocal gear system 208 and the central spur gear 214 may cause the central spur gear 214 to rotate a predetermined degree, for example, around 30 degrees in one direction and then rotate a predetermined degree, for example, around 30 degrees in the opposite direction.

The central spur gear 214 may, as shown in FIGS. 16 and 17, have a meshing surface 234 located on the central spur gear 214 and configured to contact the reciprocal gear system 208.

Figure 18:
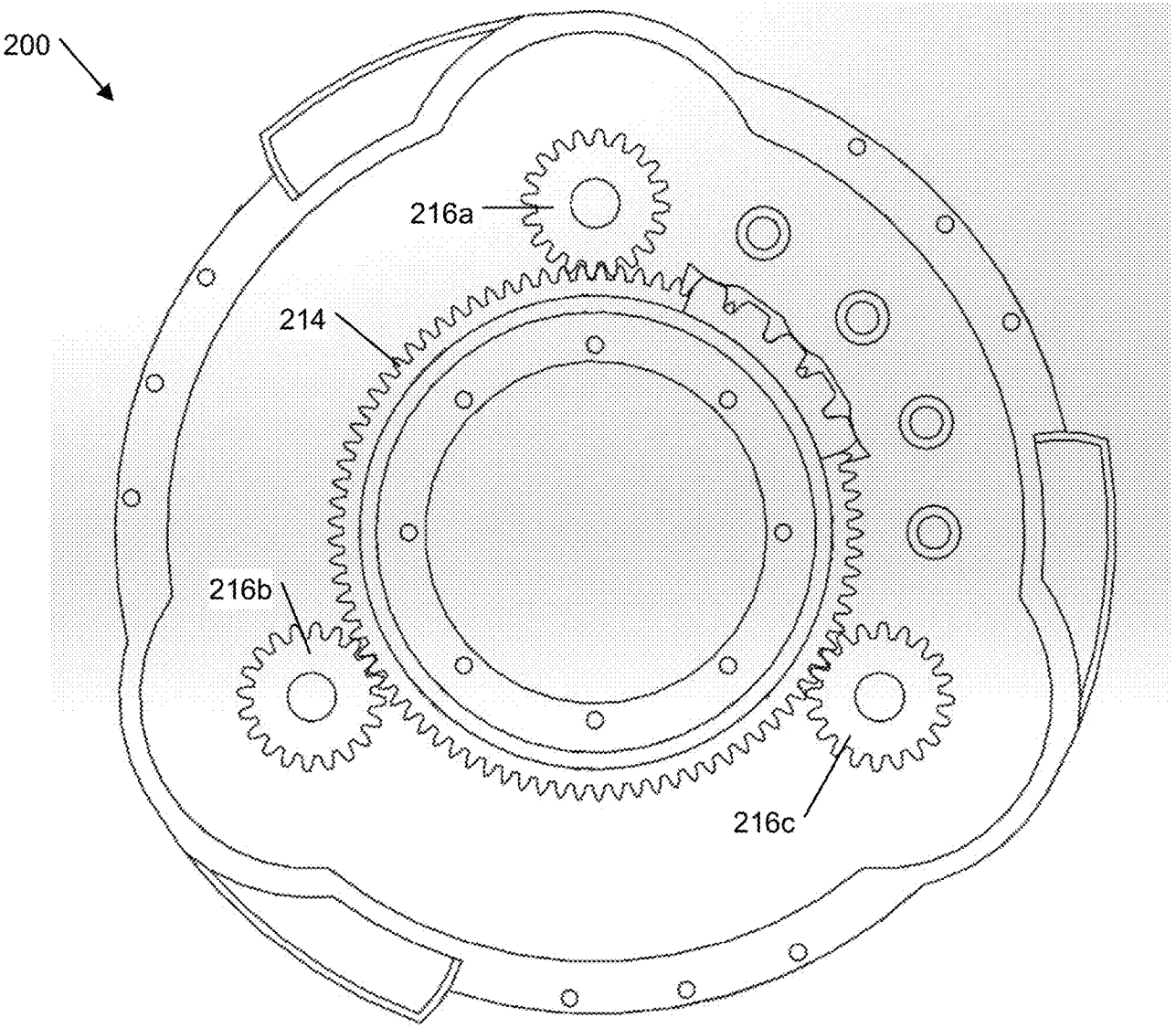
FIG. 18 is a top view of an isolated layer of the example gearbox train of FIG. 11.

Referring now to FIG. 18, shown in the central spur gear 214 in communication with three partition spur gears 216*a-c*. The partition spur gears 216*a-c* are configured to move the partition walls 108*a-c* of the compressor 100 between open and closed positions.

As with the partition walls 108 of the compressor 100, the gearbox train 200 may include fewer or more partition spur gears 216 than illustrated. The number of partition spur gears 216 of the gearbox train 200 must be equivalent to the number of partition walls 208 and blades 206 of the compressor 100.

Each partition spur gear 216 is contacted by the central spur gear 214. The central spur gear 214 may rotate a predetermined degree in a first direction and a predetermined degree in an opposing second direction.

For example, when the central spur gear 214 rotates in the counterclockwise direction, the partition spur gears 216 rotates in the clockwise direction. This rotation in the clockwise direction of the partition spur gear 216 moves the partition wall 108 from the closed position 116 to the open position 118.

Once the central spur gear 214 has completed the rotation of the predetermined degree in the counterclockwise direction, the central spur gear 214 rotates in the clockwise direction. The rotation of the central spur gear 214 in the clockwise direction rotates the partition spur gear 216 in the counterclockwise direction. The rotation of the partition spur gear 216 in the counterclockwise direction moves the partition wall 108 from the open position 118 to the closed position 116.

In some embodiments, the partition spur gears 216 may be rotated around 90 degrees in the first and second directions.

Figure 19:
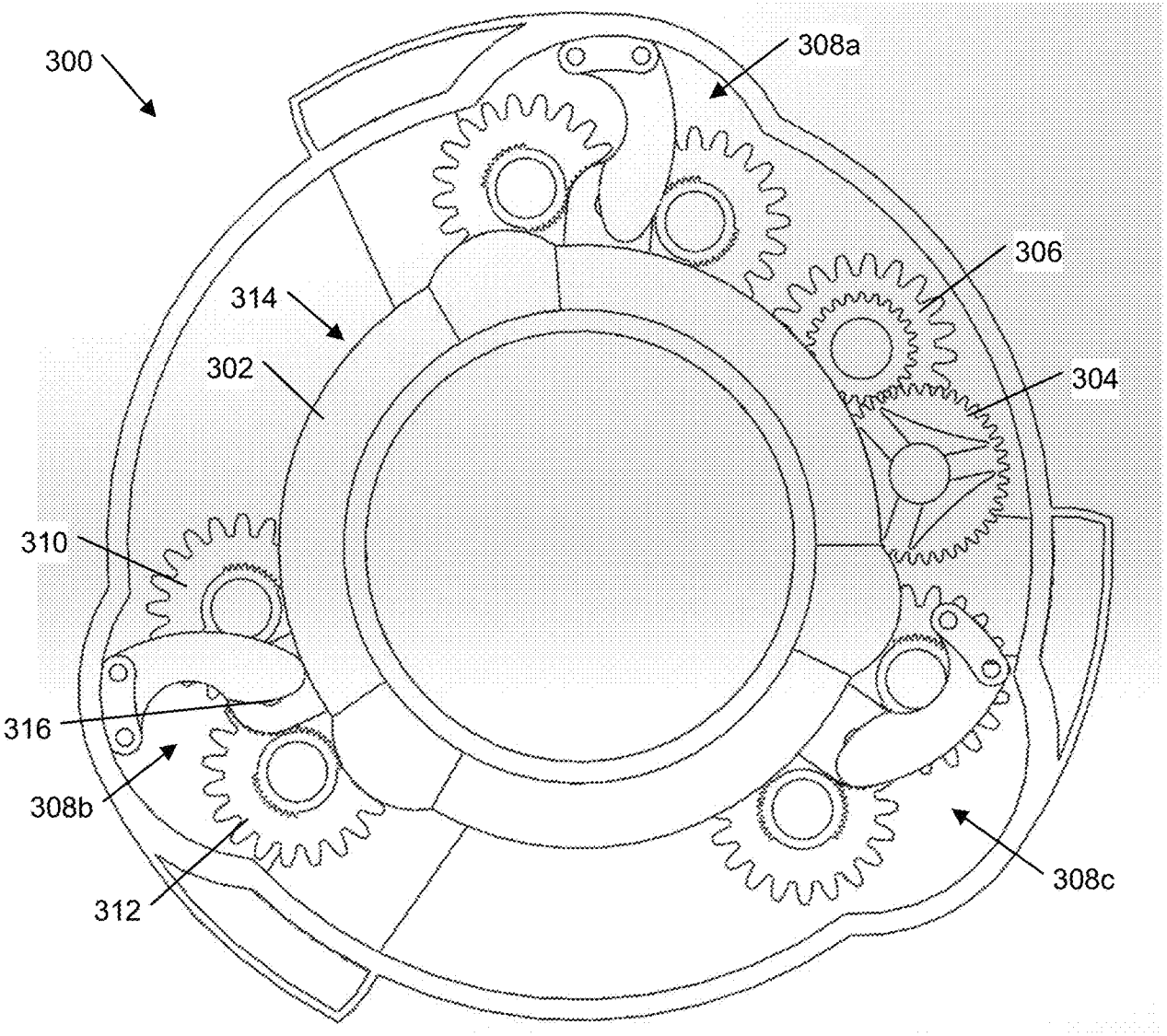
FIG. 19 is a top view of another example embodiment of a gearbox train.
Figure 20:
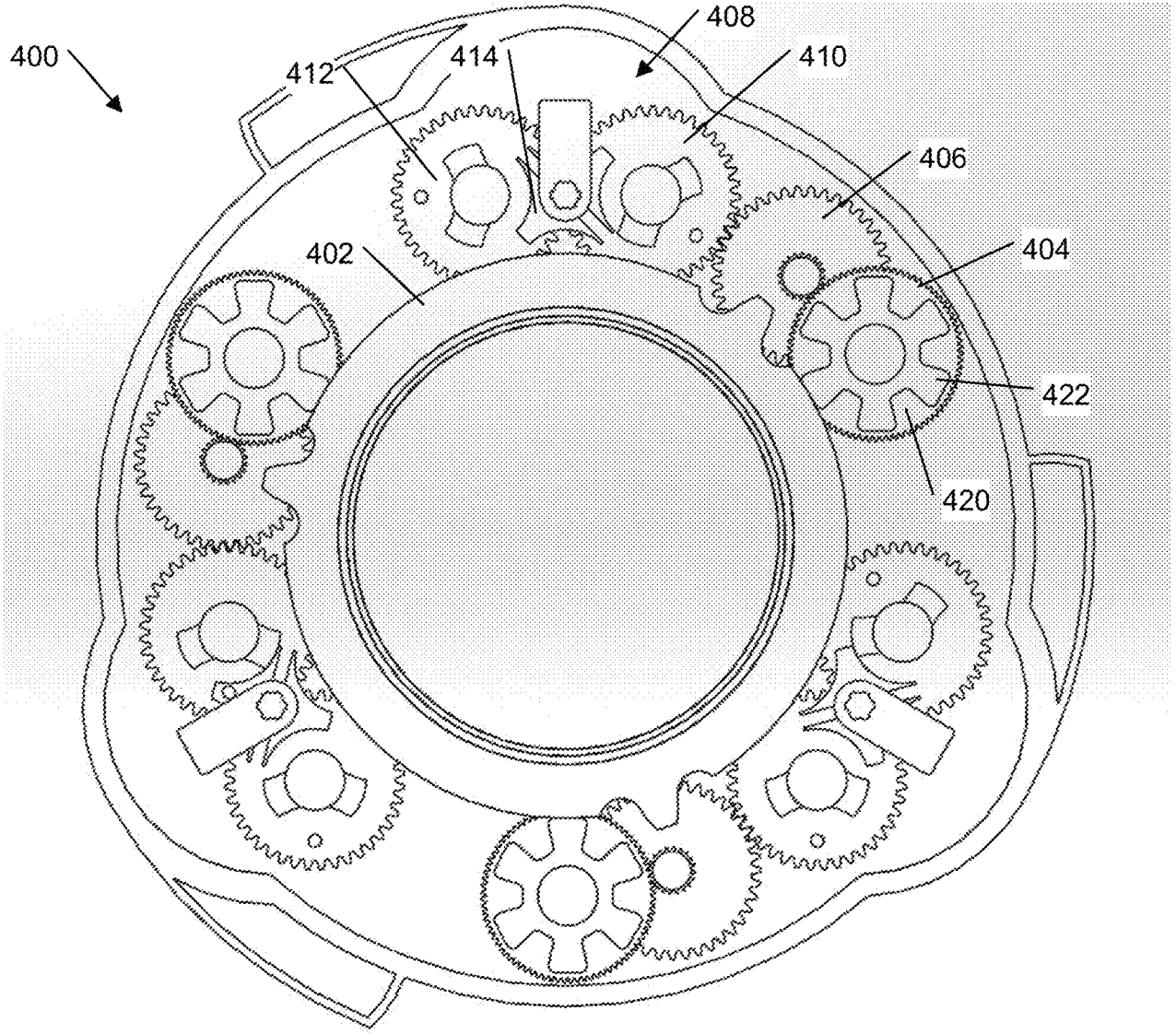
FIG. 20 is a top view of another example embodiment of a gearbox train.

Referring now to FIG. 19, shown therein is another example embodiment of a gearbox train 300 that may be implemented to move the partition walls 108 from a closed position 116 to an open position 118 and back to a closed position 116.

In the illustrated embodiment, gearbox train 300 includes a hub gear 302. The hub gear 302 may be the same circumference of the inner wall 112 of the annular chamber 102. The hub gear 302 may be in communication with the blades 106 of the compressor 100 and designed to drive the blades 106 around the annular chamber 102. The hub gear 302 rotates around the gearbox train 300 at the same angular velocity as the blades 106 around the annular chamber 102.

The hub gear 302 is in communication with the motion conversion gear 304. The motion conversion gear 304 is designed to communicate with the hub gear 302 when the blades 106 are within the predetermined degree and/or angular distance from the partition walls 108.

In the illustrated embodiment, the motion conversion gear 304 of gearbox train 300 is a three-slot Geneva gear. As such, the motion conversion gear 304 causes the conversion of the continuous motion of the hub gear 302 into intermittent motion.

The motion conversion gear 304 is in communication with a speed amplification gear 306. The speed amplification gear 306 is implemented to increase the speed of rotation of the intermittent motion of the motion conversion gear 304.

The speed amplification gear 306 is in communication with the central spur gear 314. The central spur gear 314 is configured to translate the high-speed intermittent motion of the speed amplification gear 306 to the reciprocal gear systems 308.

As illustrated, gearbox train 300 may contain multiple reciprocal gear systems 308*a-c*. In the illustrated embodiment, there are three reciprocal gear systems 308*a-c*, corresponding to the three partition walls 108*a-c* as illustrated in FIG. 1. In some embodiments, there may be fewer or more reciprocal gear systems 308 than illustrated. The number of reciprocal gear systems 308 may correspond to the number of partition walls 108 of the compressor.

The reciprocal gear system 308 includes a first reciprocal gear 310, a second reciprocal gear 312 and a third reciprocal gear 316. In some embodiments, the reciprocal gear system 308 may include three traditional spur gears.

The central spur gear 314 is configured to contact the first reciprocal gear 310, causing the first reciprocal gear 310 to rotate in a first direction. The first reciprocal gear 310 then contacts the second reciprocal gear 312, causing the second reciprocal gear 312 to rotate in a second direction.

The first reciprocal gear 310 and the second reciprocal gear 312 are both in contact with the third reciprocal gear 316. The rotation of the first reciprocal gear 310 in the first direction causes the third reciprocal gear 316 to rotate in the second direction. The rotation of the third reciprocal gear 316 in the second direction may cause, in turn, partition wall 108 of the compressor 100 to move from the closed position 116 to the open position 118.

For example, when the central spur gear 314 is rotated in a counterclockwise direction, it triggers the first reciprocal gear 310 to rotate in the clockwise direction. The rotation of the first reciprocal gear 310 in the clockwise direction causes the third reciprocal gear 316 to rotate in the counterclockwise direction. The counterclockwise rotation of the third reciprocal gear 316 causes the partition wall 108 of the compressor 100 to move from a closed position 116 to an open position 118.

The rotation of the second reciprocal gear 312 in the second direction may cause the third reciprocal gear 316 to rotate in the first direction. The rotation of the third reciprocal gear 316 in the first direction may cause, in turn, partition wall 108 of the compressor 100 to move from the open position 118 to the closed position 116.

For example, when the central spur gear 314 is rotated in a clockwise direction, it causes rotation of the second reciprocal gear 312 in the counterclockwise direction. This causes the third reciprocal gear 316 to rotate in the clockwise direction. The clockwise rotation of the third reciprocal gear 316 causes the partition wall 108 of the compression 100 to move from an open position 118 to a closed position 116.

The third reciprocal gear 316 is first in contact with the first reciprocal gear 310 to move the partition wall 108 to the open position 118. Once the partition wall 108 has been moved to the open position 118, the second reciprocal gear 312 contacts the third reciprocal gear 316 to move the partition wall 108 to the closed position 116. For example, the third reciprocal gear 316 originally is in communication with the first reciprocal gear 310 and only interacts with the second reciprocal gear 312 after the third reciprocal gear 316 has completed the predetermined angular rotation to move the partition wall 108 to the open position 118.

Figure 21:
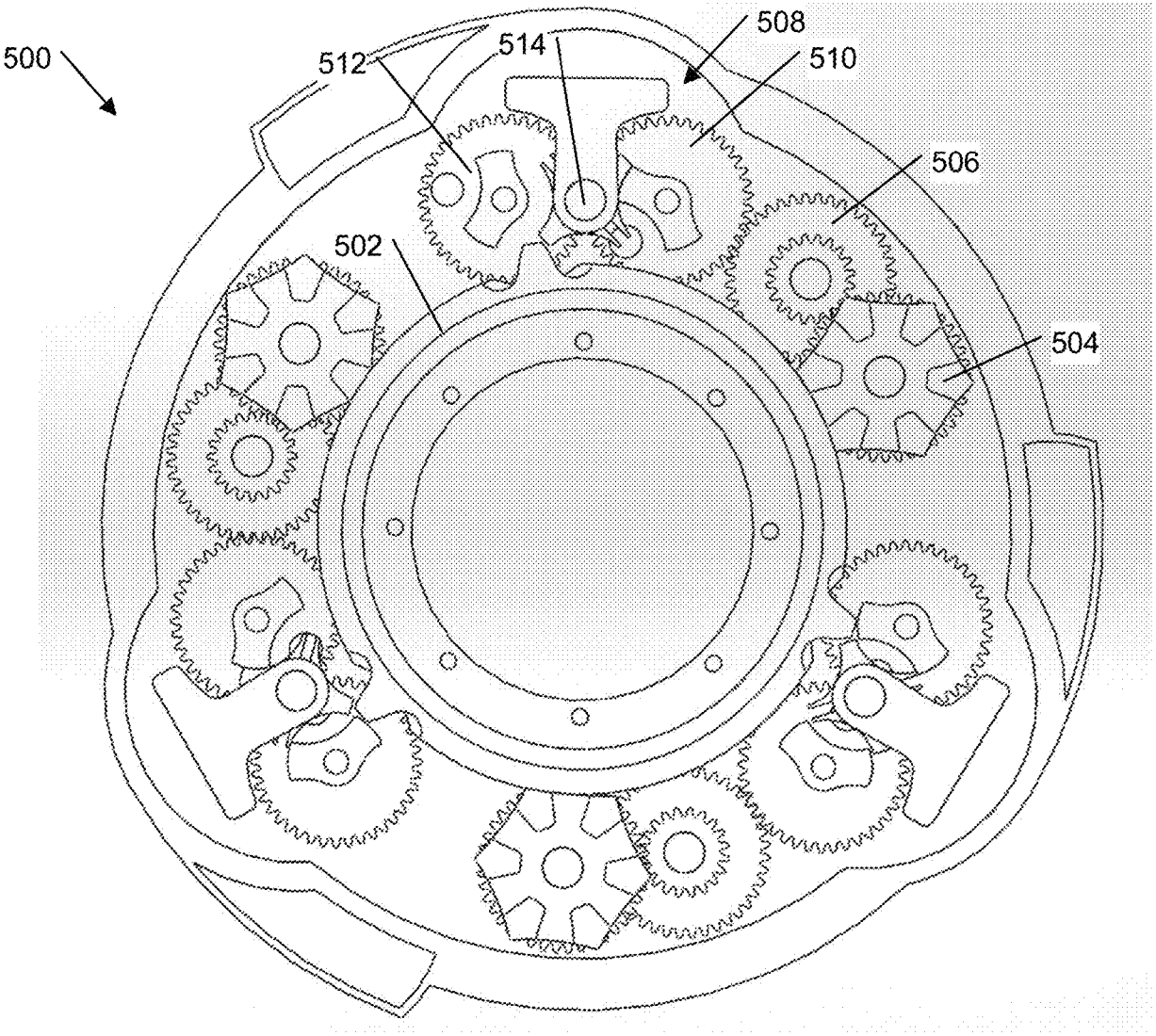
FIG. 21 is a top view of another example embodiment of a gearbox train.

Referring now to FIG. 21, shown therein in another example embodiment of a gearbox train 400. In this embodiment, the gearbox train 400 comprises a complete set of gears for each partition wall, with the exception of the gear used to rotate the blades.

In the illustrated embodiment, gearbox train 400 includes a hub gear 402. The hub gear 402 may be the same circumference of the inner wall 112 of the annular chamber 102. The hub gear 402 may be in communication with the blades 106 of the compressor 100 and designed to drive the blades 106 around the annular chamber 102. The hub gear 402 rotates around the gearbox train 400 at the same angular velocity as the blades 106 around the annular chamber 102.

The hub gear 402 is in communication with the motion conversion gear 404. The motion conversion gear 404 is designed to communicate with the hub gear 402 when the blades 106 are within the predetermined degree and/or angular distance from the partition walls 108.

As illustrated, gearbox train 400 contains multiple motion conversion gears 404. Each motion conversion gear 404 creates a geartrain configured to move a single partition wall 108. In the illustrated embodiment, there are three motion conversion gears 404*a-c* and three geartrains. In some embodiments, there may be fewer or more geartrains than illustrated. In this embodiment, the number of geartrains of gearbox train 400 corresponds to the number of partition walls 108 of the compressor.

In the illustrated embodiment, the motion conversion gear 404 of gearbox train 400 is generally analogous to the motion conversion gear 204 of gearbox train 200. However, as illustrated, the lower layer 420 of motion conversion gear 404 is of a circular shape, in comparison to the hexagonal lower layer 220 of motion conversion gear 204. The motion conversion gear 404 is configured to cause the conversion of the continuous motion of the hub gear 402 into intermittent motion. In some embodiments, the motion conversion gear 404 may be the same as the motion conversion gear 204. This embodiment is illustrated in FIG. 21, which shown another example embodiment of a gearbox train 500.

The motion conversion gear 404 is in communication with a speed amplification gear 406. The speed amplification gear 406 is implemented to increase the speed of rotation of the intermittent motion of the motion conversion gear 404.

The speed amplification gear 306 is in communication with the reciprocal gear system 308. In some embodiments, the reciprocal gear system 308 may be a double reciprocating Geneva mechanism.

As shown, the reciprocal gear system 408 includes a first reciprocal gear 410, a second reciprocal gear 412 and a third reciprocal gear 414.

The speed amplification gear 406 is configured to contact the first reciprocal gear 410, causing the first reciprocal gear 410 to rotate in a first direction. After the first reciprocal gear 410 undergoes a predetermined rotation, it engages the second reciprocal gear 412, causing the second reciprocal gear 412 to rotate in a second direction.

The first reciprocal gear 410 and the second reciprocal gear 412 are both in contact with the third reciprocal gear 414. The rotation of the first reciprocal gear 410 in the first direction causes the third reciprocal gear 414 to rotate in the second direction. The rotation of the third reciprocal gear 414 in the second direction causes, in turn, partition wall 108 of the compressor 100 to move from the closed position 116 to the open position 118.

The rotation of the second reciprocal gear 412 in the second direction causes the third reciprocal gear 414 to rotate in the first direction. The rotation of the third reciprocal gear 414 in the first direction causes, in turn, partition wall 108 of the compressor 100 to move from the open position 118 to the closed position 116.

Figure 22:
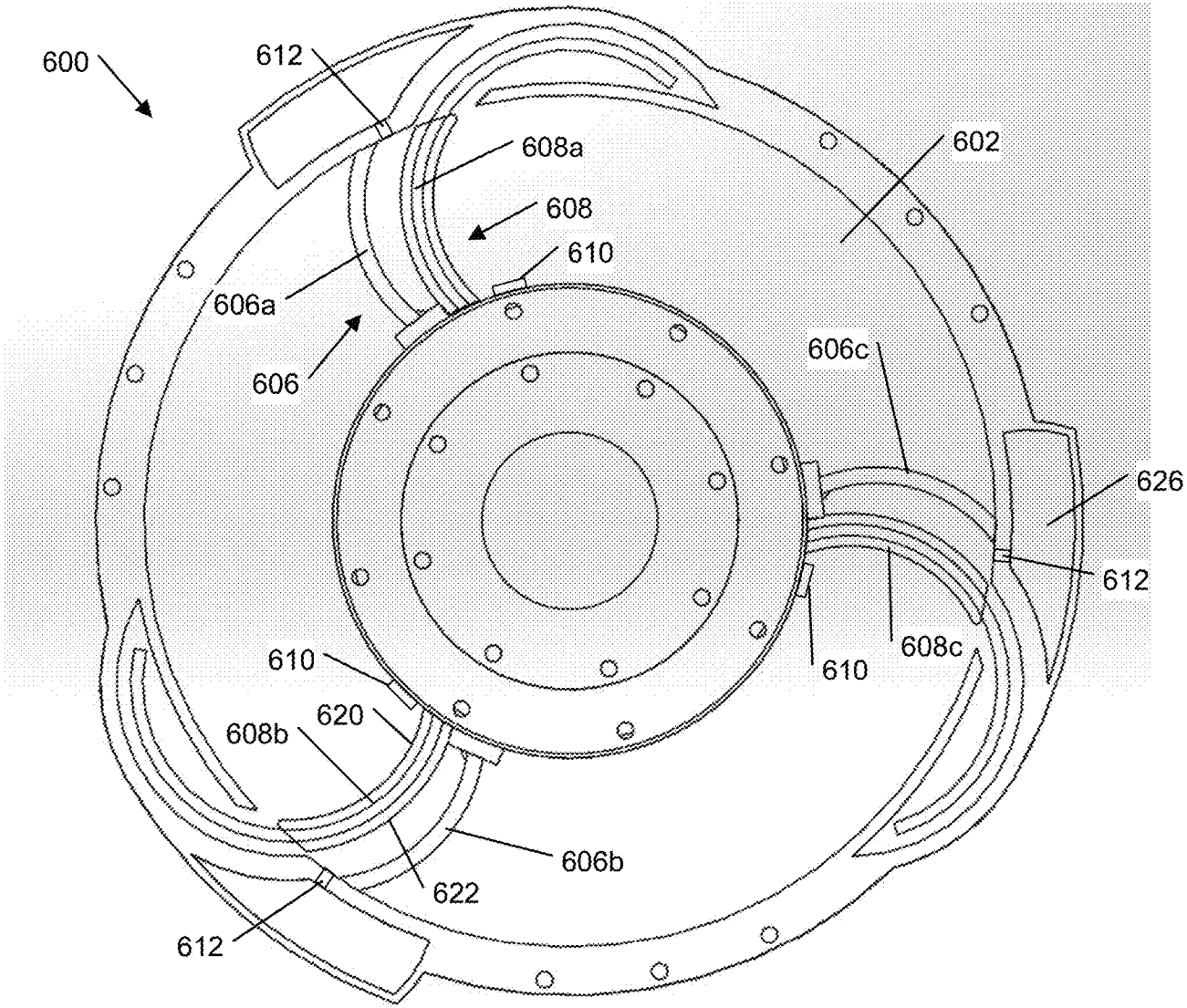
FIG. 22 is a top view of an example embodiment of an internal combustion engine.
Figure 23:
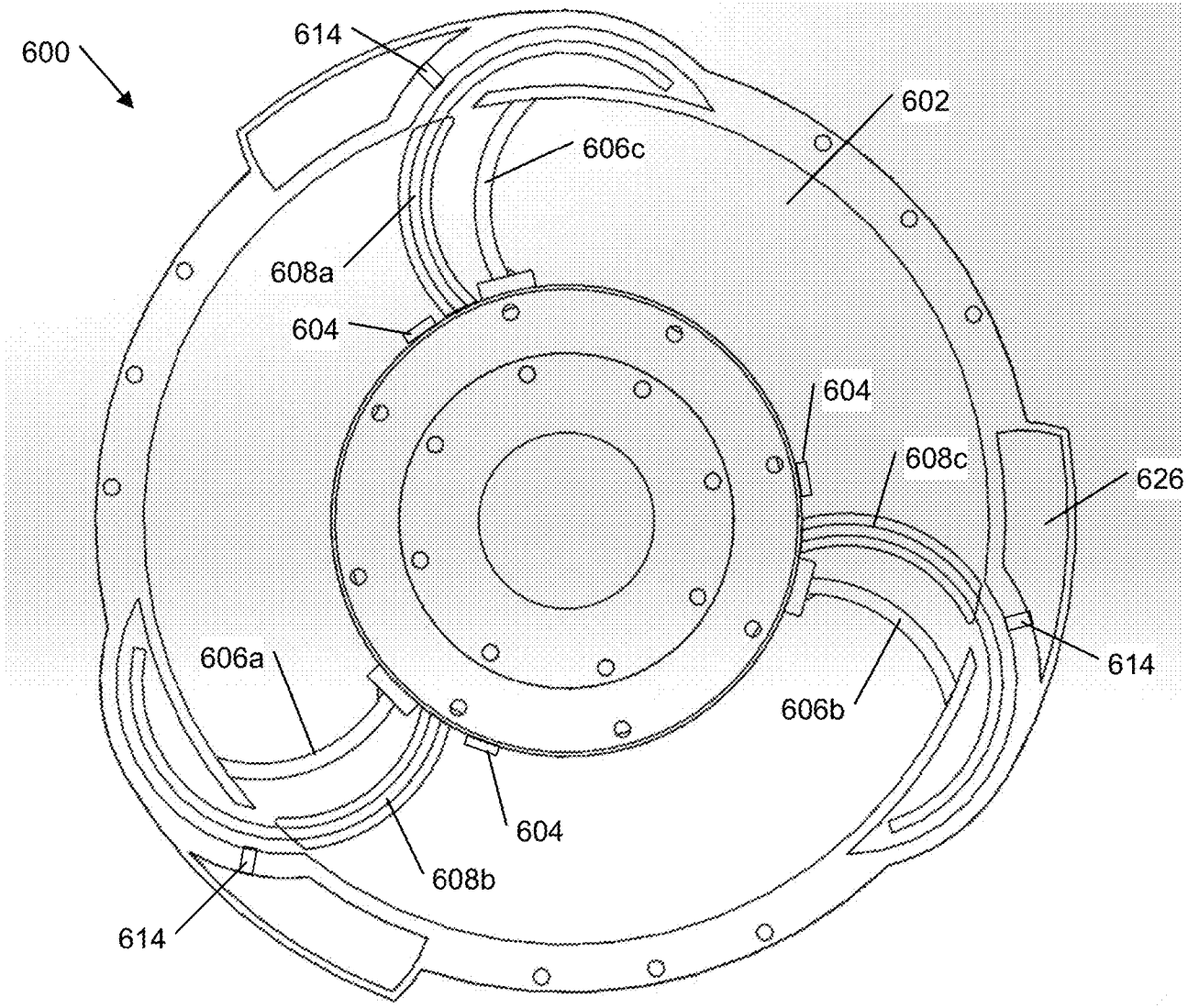
FIG. 23 is a top view of the example internal combustion engine.

Referring now to FIGS. 22 and 23, shown therein is an example embodiment of an internal combustion engine 600. The internal combustion engine 600 is an illustration of an application of a compressor as discussed in this application. Any of the embodiments of the compressor 100 as discussed herein can be used in the internal combustion engine 600 application.

In the illustrated embodiment, engine 600 includes three annular chambers 602, at least one inlet port 604, three blades 606, three partition walls 608, and three combustion chambers 626. This embodiment is analogous to the compressor embodiment of FIG. 1.

In a similar method to compressor 100, air enters into the annular chamber 602 of engine 600 through inlet port 604, where blades 606 are moving continuously around annular chamber 602. The blades 606 compress the air between the blades 606 and the partition walls 608 within the annular chamber 602. The annular chamber 602 may also be referred to as a compression chamber.

Combustion chamber 626 has an airflow port 614 fluidly connecting a combustion chamber 626 with an annular chamber 602. The airflow port 614 may have a mechanism able to close the port and seal the combustion chamber. For example, airflow port 614 may include a door, a valve, etc., or any other closing mechanism.

Compressed air is pushed out the airflow port 614 of the annular chamber 602 into the combustion chamber 626. The airflow port 614 may then close the combustion chamber 626, sealing in the compressed air.

The combustion chamber 626 may further include a spraying mechanism configured to inject the combustion chamber 626 with a fuel spray and a spark plug. As such, when the compressed air has been sealed within the combustion chamber 626, the combustion chamber 626 may be injected with a fuel spray, thereby creating a combustible mix of the compressed air and fuel spray. The spark plug may then ignite the mixture of compressed air and fuel spray, forcing the expanded gases out of the combustion chamber 626 and into the annular chamber 602. The expanded gases are output into the annular chamber 602 through passage 612 (shown in FIG. 22).

The expansion gases being forced back into the annular chamber 602 through passage 612 may push the blades 606 around the annular chamber 602.

Once the expansion gases have been brought back into the annular chamber 602, the blade 606 may push the exhaust gases from the annular chamber 602 through the outlet port 610 of the annular chamber 602. The motion of the blade 606 through the annular chamber 602 may create a suction force to bring in air through the inlet port 604 into the annular chamber 602.

Motion of the partition walls 608 of the engine 600 may be facilitated using any method disclosed above in relation to gearbox trains 200, 300, 400, 500.

Referring again to FIG. 22, shown therein is the engine 600 at a first stage of the combustion cycle, where the blades 606*a-c* are located within the annular chamber 602 near the partition walls 608*a-c*.

For exemplary purposes, the blades 606*a-c* are moving around the annular chamber 602 in a counterclockwise direction. To illustrate the method and compression of the engine 600, blade 606*a* will be followed through the compression cycle.

At the first stage, air is received into the annular chamber 602 through the inlet port 604 (shown in FIG. 23) of the engine 600. Air enters via the inlet port 604 into the annular chamber 602, filling the space between the blade 606*a* and partition wall 608*b*. Partition wall 608*b* is in the closed position, as illustrated.

Blade 606*a* moves in a continuous motion in the counterclockwise direction around the annular chamber 602 towards partition walls 608*b*, compressing the air from inlet port 604 between blade 606*a* and the first side 620 of partition wall 608*b*.

Referring now to FIG. 23, blade 606*a* has moved through the annular chamber 602 towards partition wall 608*b*, which remains in the closed position. Blade 606*a* applies pressure on the air within annular chamber 602 trapped between blade 606*a* and partition wall 608*b*.

The partitions wall 608*b* then is moved from the closed position to the open position, opening the airflow port 614. As blade 606*a* moves from the first side 620 of the partition wall 608*b* to the second side 622 of the partition wall 608*b*, the compressed air is moved through the airflow port 614 into the combustion chamber 626.

Blade 606*a* continues along the annular chamber 602 in the counterclockwise direction towards partition wall 608*c*, compressing the air brought in through the inlet port 604. Simultaneously, within the combustion chamber 626, the compressed air is injected with a fuel spray creating a combustible mix.

Partition wall 608*c* then moves from the closed position to the open position, allowing blade 606*a* to pass from the first side 620 to the second side 622 of the partition wall 608*c*. Simultaneously to blade 606*a* passing partition wall 608*c*, the spark plug within the combustion chamber 626 ignites the combustible mix, expanding the air within the combustion chamber 626. This air expansion forces the expanded air from the combustion chamber 626, through passage 612 (as shown in FIG. 22) and back into the annular chamber 602.

The expanded air is forced through passage 612 into the annular chamber 602 between blade 606*a* and the second side 622 of the corresponding partition wall 608*c* located outside the combustion chamber 626. The expanded air forces the blade 606*a* to continue the rotary motion through the annular chamber 602.

The exhaust gases are then moved through the annular chamber 602 and pushed out outlet port 610 by blade 606*a* as blade 606*a* completes a full rotation around the annular chamber 602 by nearing the first side 620 of partition wall 608*a*. As blade 606*a* pushes the exhaust gases out of outlet port 610, the suction force created between blade 606*a* and the second side of partition wall 608*c* pulls fresh air in through inlet port 604, restarting the combustion cycle.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

CLAUSES

Item 1: A compressor device comprising: an annular chamber comprising an inner wall and an outer wall; at least one inlet port within the annular chamber, the annular chamber receiving air through the at least one inlet port configured to receive air into the annular chamber; at least one blade in communication with the inner wall and moveable around the annular chamber, the at least one blade configured to compress the air received from the at least one inlet port; at least one partition wall between the inner wall and the outer wall moveable between a closed position and an open position, wherein the at least one partition wall is configured to close a space between the inner wall and the outer wall of the annular chamber when in the closed position, and configured to create space between the inner wall and the outer wall of the annular chamber when in the open position; wherein when the at least one partition wall is in the closed position, the at least one blade approaching the at least one corresponding partition wall causes the air to compress to generate compressed air; wherein when the at least one partition wall is in the open position, the at least one blade moves from a first side of the corresponding at least one partition wall to a second side of the at least one corresponding partition wall; and at least one outlet port within the annular chamber, the at least one outlet port configured to release the compressed air from the annular chamber after the at least one blade has moved to the second side of the at least one corresponding partition wall.

Item 2: The compressor device of item 1, further comprising at least two blades and at least two partition walls, the at least two partition walls forming at least two interior chambers of the annular chamber when in the closed position.

Item 3: The compressor device of items 1 or 2, further comprising at least three blades and at least three partition walls, the at least three partition walls forming at least three interior chambers of the annular chamber when in the closed position.

Item 4: The compressor device of any one of items 1 to 3, further comprising at least four blades and at least four partition walls, the at least four partition walls forming at least four interior chambers of the annular chamber when in the closed position.

Item 5: The compressor device of item 1, wherein the at least one blade is configured to create a suction force between the at least one blade and the second side of the at least one corresponding partition wall, drawing the air in from the inlet port into the annular chamber.

Item 6: The compressor device of any one of items 1 to 5, wherein the at least one partition wall, when in a closed position, forms an airtight seal between the inner wall and the outer wall of the annular chamber.

Item 7: The compressor device of item 6, wherein the at least one partition wall is moveable between the closed position and the open position by a gearbox train, wherein the gearbox train is configured to open the at least one partition wall when the at least one blade is within a predetermined distance of and approaching the at least one partition wall, and wherein the gearbox train is configured to close the at least one partition wall when the at least one blade is within a second predetermined distance of and has passed the at least one corresponding partition wall.

Item 8: The compressor device of item 7, wherein the gearbox train comprises: a hub gear in communication with the at least one blade and configured to continuously drive the at least one blade within the device; a motion conversion gear in communication with the hub gear and configured to interact with the hub gear when the at least one blade is located within a predetermined angular distance from the at least one partition wall, wherein the motion conversion gear causes the conversion of continuous motion of the hub gear into intermittent motion of the motion conversion gear; a speed amplification gear in communication with the motion conversion gear and configured to convert the intermittent motion of the motion conversion gear into a high-speed intermittent motion of the speed amplification gear; a reciprocal gear system in communication with the speed amplification gear and configured to rotate when interacting with the speed amplification gear; a central spur gear in communication with the reciprocal gear system and configured to rotate a predetermined degree in a first direction and a predetermined degree in a second direction opposing the first direction; and at least one partition spur gear in communication with the central reciprocal gear and configured to move the at least one partition wall; wherein when the central spur gear moves in the first direction, the at least one partition spur gear is rotated in the second direction and wherein when the central spur gear moves in the second direction, the at least one partition spur gear is rotated in first direction; wherein the at least one partition wall is moved from a closed position to an open position when the at least one partition spur gear is rotated in the second direction; and wherein the at least one partition wall is moved from the open position to the closed position when the at least one partition spur gear is rotated in the first direction.

Item 9: The compressor device of item 8, wherein the reciprocal gear system comprises: a first reciprocal gear in communication with the speed amplification gear and the central spur gear and configured to rotate in the first direction; and a second reciprocal gear in communication with the first reciprocal gear and the central spur gear and configured to rotate in the second direction.

Item 10: The compressor device of item 9, wherein the second reciprocal gear interacts with the central spur gear to rotate the central reciprocal gear in the first direction and the first reciprocal gear interacts with the central reciprocal gear to rotate the central reciprocal gear in the second direction.

Item 11: The compressor device of any one of items 8 to 10, wherein the motion conversion gear has a first layer of a hexagonal shape and a second layer above the first layer, the second laying having an involute curved profile.

Item 12: A method of compressing air within a compressor device, the method comprising: receiving air through an inlet port of the compressor device, the compressor device comprising: an annular chamber comprising an inner wall and an outer wall; at least one inlet port within the annular chamber, the at least one inlet port configured to flow air into the annular chamber; at least one blade in communication with the inner wall and moveable around the annular chamber, the at least one blade configured to compress the air flow from the at least one inlet port; at least one partition wall between the inner wall and the outer wall moveable between a closed position and an open position, wherein the at least one partition wall is configured to close a space between the inner wall and the outer wall of the annular chamber when in the closed position, and configured to create space between the inner wall and the outer wall of the annular chamber when in the open position; and at least one outlet port within the annular chamber, the at least one outlet port configured to release the compressed air from the annular chamber; moving the at least one blade in a continuous motion around the annular chamber; compressing, between the at least one blade and the at least one partition wall in the closed position, the received air within the annular chamber; and outputting the compressed air through the outlet port of the compressor device when the at least one partition wall is moved to the open position.

Item 13: The method of item 12, further comprising moving the at least one partition wall from the closed position to the open position to allow the at least one blade to move from a first side of the at least one partition wall to a second side of the at least one partition wall.

Item 14: The method of item 13, further comprising moving the at least one partition wall from the open position to the closed position after the at least one blade has moved to the second side of the at least one partition wall.

Item 15: The method of item 14, wherein the compressor device comprises at least two blades and at least two partition walls, the at least two partition walls forming at least two interior chambers of the annular chamber when in the closed position.

Item 16: The method of item 15, wherein the compressor device comprises at least three blades and at least three partition walls, the at least three partition walls forming at least three interior chambers of the annular chamber when in the closed position.

Item 17: The method of item 16, wherein the compressor device comprises at least four blades and at least four partition walls, the at least four partition walls forming at least four interior chambers of the annular chamber when in the closed position Item 18: The method of any one of items 12 to 17, further comprising creating a suction force between the at least one blade and the second side of the at least one partition wall, drawing the air flow in from the inlet port into the annular chamber.

Item 19: The method of any one of items 12 to 18, wherein the at least one partition wall, when in a closed position, forms an airtight seal between the inner wall and the outer wall of the annular chamber.

Item 20: The method of item 19, further comprising moving the at least one partition wall between the closed position and the open position by a gearbox train, wherein the gearbox train is configured to open the at least one partition wall when the at least one blade is within a predetermined distance of and approaching the at least one partition wall, and wherein the gearbox train is configured to close the at least one partition wall when the at least one blade is within a second predetermined distance of and has passed the at least one corresponding partition wall.

Item 21: The method of item 20, further comprising: driving the at least one blade around the annular chamber by a hub gear of the gearbox train, the hub gear in communication with a motion conversion gear; converting, by the motion conversion gear, continuous movement of the hub gear to intermittent motion of the motion conversion gear; rotating, by the motion conversion gear, a speed amplification gear configured to convert the intermittent motion of the motion conversion gear into a high-speed intermitted motion of the speed amplification gear; rotating, by the speed amplification gear, a reciprocal gear system; rotating, by the reciprocal gear system, a central spur gear configured to rotate a predetermined degree in a first direction and a predetermined degree in a second direction opposing the first direction; rotating the at least one partition spur gear in a second direction when the central spur gear moves in the first direction; moving the at least one partition wall from a closed position to an open position when the at least one partition spur gear is rotated in the second direction; rotating the at least one partition spur gear in a first direction when the central spur gear moves in the second direction; and moving the at least one partition wall from the open position to the closed position when the at least one partition spur gear is rotated in the first direction.

Item 22: The method of item 21, wherein the motion conversion gear is configured to interact with the hub gear when the at least one blade driven by the hub gear is located within a determined angular distance from the at least one partition wall.

Item 23: The method of items 21 or 22, wherein the reciprocal gear system comprises: a first reciprocal gear in communication with the speed amplification gear and the central spur gear and configured to rotate in the second direction; and a second reciprocal gear in communication with the first reciprocal gear and the central spur gear and configured to rotate in the first direction; wherein the first reciprocal gear is rotated in the second direction when the at least one blade is within a predetermined distance of a first side of the at least one corresponding partition wall; and wherein the second reciprocal gear is rotated in the first direction when the at least one blade has moved to a second side of the at least one corresponding partition wall.

Item 24: The method of item 23, wherein the second reciprocal gear interacts with the central spur gear to rotate the central spur gear in the first direction and the first reciprocal gear interacts with the central spur gear to rotate the central spur gear in the second direction.

Item 25: A control mechanism for movement of a partition wall, the control mechanism comprising: a gearbox train in communication with at least one blade and at least one partition wall of a device, wherein the gearbox train is configured to open the at least one partition wall when the at least one blade is within a predetermined distance of and approaching the at least one partition wall, and wherein the gearbox train is configured to close the at least one partition wall when the at least one blade is within a second predetermined distance of and has passed the at least one corresponding partition wall.

Item 26: The control mechanism of item 25, wherein the gearbox train comprises: a hub gear in communication with the at least one blade and configured to continuously drive the at least one blade within the device; a motion conversion gear in communication with the hub gear and configured to interact with the hub gear when the at least one blade is located within a predetermined angular distance from the at least one partition wall, wherein the motion conversion gear causes the conversion of continuous motion of the hub gear into intermittent motion of the motion conversion gear; a speed amplification gear in communication with the motion conversion gear and configured to convert the intermitted motion of the motion conversion gear into a high-speed intermittent motion of the speed amplification gear; a central spur gear in communication with the speed amplification gear and configured to translate the high-speed intermittent motion of the speed amplification gear to at least one reciprocal gear system; and the at least one reciprocal gear system in communication with the central spur gear and configured to rotate when interacting with the central spur gear; wherein the at least one reciprocal gear system is configured to control the at least one corresponding partition wall.

Item 27: The control mechanism of item 26, wherein the at least one reciprocal gear system comprises: a first reciprocal gear in communication with the central spur gear and configured to rotate in the first direction when the at least one blade is within a predetermined distance of a first side of the at least one corresponding partition wall; a second reciprocal gear in communication with the first reciprocal gear and configured to rotate in the second direction when the at least one blade has moved to a second side of the at least one corresponding partition wall; and a third reciprocal gear in communication with the first reciprocal gear and the second reciprocal gear, wherein the third reciprocal gear is configured to rotate a predetermined degree in the second direction when in communication with the first reciprocal gear, and the third reciprocal gear is configured to rotate a predetermined degree in the first direction when in communication with the second reciprocal gear; wherein the at least one partition wall is moved from a closed position to an open position when the third reciprocal gear is rotated in the second direction; and wherein the at least one partition wall is moved from the open position to the closed position when the third reciprocal gear is rotated in the first direction.

Item 28: The control mechanism of item 27, wherein the rotation of the first reciprocal gear in the first direction moves the third reciprocal gear in the second direction and the rotation of the second reciprocal gear in the second direction moves the third reciprocal gear in the first direction.

Item 29: The control mechanism of any one of items 25 to 28, wherein the number of reciprocal gear systems correspond to the number of blades and partition walls of the device.

Item 30: The control mechanism of any one of items 25 to 29, wherein the motion conversion gear is a three-slot Geneva gear.

Item 31: The control mechanism of item 25, wherein the gearbox train comprises: a hub gear in communication with the at least one blade and configured to continuously drive the at least one blade within the device; at least one motion conversion gear in communication with the hub gear and configured to interact with the hub gear when the at least one blade is located within a predetermined angular distance from the at least one partition wall, wherein the at least one motion conversion gear causes the conversion of continuous motion of the hub gear into intermittent motion of the at least one motion conversion gear; at least one speed amplification gear in communication with the at least one motion conversion gear and configured to increase the speed of rotation; and at least one reciprocal gear system in communication with the at least one speed amplification gear and configured to rotate when interacting with the at least one speed amplification gear; wherein the at least one reciprocal gear system is configured to control the at least one corresponding partition wall.

Item 32: The control mechanism of item 31, wherein the at least one reciprocal gear system comprises: a first reciprocal gear in communication with the at least one speed amplification gear and configured to rotate in the first direction when the at least one blade is within a predetermined distance of a first side of the at least one corresponding partition wall; and a second reciprocal gear in communication with the first reciprocal gear and configured to rotate in the second direction when the at least one blade has moved to a second side of the at least one corresponding partition wall; a third reciprocal gear in communication with the first reciprocal gear and the second reciprocal gear, wherein the third reciprocal gear is configured to rotate a predetermined degree in the second direction when in communication with the first reciprocal gear, and the third reciprocal gear is configured to rotate a predetermined degree in the first direction when in communication with the second reciprocal gear; wherein the at least one partition wall is moved from a closed position to an open position when the third reciprocal gear is rotated in the second direction; and wherein the at least one partition wall is moved from the open position to the closed position when the third reciprocal gear is rotated in the first direction.

Item 33: The control mechanism of item 32, wherein the at least one reciprocal gear system is a double reciprocating Geneva mechanism.

Item 34: The control mechanism of any one of items 32 or 33, wherein the rotation of the first reciprocal gear in the first direction moves the third reciprocal gear in the second direction and the rotation of the second reciprocal gear in the second direction moves the third reciprocal gear in the first direction.

Item 35: The control mechanism of any one of items 31 to 34, wherein the number of motion conversion gears, speed amplification gears, and reciprocal gear systems correspond to the number of blades and corresponding partition walls of the device.

Item 36: The control mechanism of item 25, wherein the gearbox train comprises: a hub gear in communication with the at least one blade and configured to continuously drive the at least one blade within the device; a motion conversion gear in communication with the hub gear and configured to interact with the hub gear when the at least one blade is located within a predetermined angular distance from the at least one partition wall, wherein the motion conversion gear causes the conversion of continuous motion of the hub gear into intermittent motion of the motion conversion gear; a speed amplification gear in communication with the motion conversion gear and configured to convert the intermittent motion of the motion conversion gear into a high-speed intermitted motion of the speed amplification gear; a reciprocal gear system in communication with the speed amplification gear and configured to rotate when interacting with the speed amplification gear; a central spur gear in communication with the reciprocal gear system and configured to rotate a predetermined degree in a first direction and a predetermined degree in a second direction opposing the first direction; and at least one partition spur gear in communication with the central reciprocal gear and configured to move the at least one partition wall; wherein when the central spur gear moves in the first direction, the at least one partition spur gear is rotated in the second direction and wherein when the central spur gear moves in the second direction, the at least one partition spur gear is rotated in first direction; wherein the at least one partition wall is moved from a closed position to an open position when the at least one partition spur gear is rotated in the second direction; and wherein the at least one partition wall is moved from the open position to the closed position when the at least one partition spur gear is rotated in the first direction.

Item 37: The control mechanism of item 36, wherein the reciprocal gear system comprises: a first reciprocal gear in communication with the speed amplification gear and the central spur gear and configured to rotate in the second direction; and a second reciprocal gear in communication with the first reciprocal gear and the central spur gear and configured to rotate in the first direction; wherein the first reciprocal gear is rotated in the second direction when the at least one blade is within a predetermined distance of a first side of the at least one corresponding partition wall; and wherein the second reciprocal gear is rotated in the first direction when the at least one blade has moved to a second side of the at least one corresponding partition wall.

Item 38: The control mechanism of item 37, wherein the second reciprocal gear interacts with the central spur gear to rotate the central spur gear in the first direction and the first reciprocal gear interacts with the central spur gear to rotate the central spur gear in the second direction.

Item 39: The control mechanism of any one of items 35 to 37, wherein the number of partition spur gears corresponds to the number of blades and corresponding partition walls of the device.

Item 40: The control mechanism of any one of items 35 to 38, wherein the motion conversion gear has a first layer of a hexagonal shape and a second layer above the first layer, the second laying having an involute curved profile.

Item 41: The control mechanism of any one of items 25 to 40, wherein the device is an air compressor.

Item 42: The control mechanism of any one of items 25 to 40, wherein the device is an internal combustion engine.

Item 43: A method of controlling the movement of at least one partition wall of a device using a control mechanism, the method comprising: at least one blade of the device approaching the at least one partition wall wherein, when the at least one blade is within a predetermined distance of the at least one partition wall, a hub gear in communication with the at least one blade and configured to continually move the at least one blade within the device interacts with a motion conversion gear; converting, by the motion conversion gear, continuous movement of the hub gear to intermittent motion of the motion conversion gear; rotating, by the motion conversion gear, a speed amplification gear configured to convert the intermittent motion of the motion conversion gear into a high-speed intermitted motion of the speed amplification gear; rotating, by the speed amplification gear, a reciprocal gear system; rotating, by the reciprocal gear system, a central spur gear configured to rotate a predetermined degree in a first direction and a predetermined degree in a second direction opposing the first direction; rotating the at least one partition spur gear in a second direction when the central spur gear moves in the first direction; moving the at least one partition wall from a closed position to an open position when the at least one partition spur gear is rotated in the second direction; rotating the at least one partition spur gear in a first direction when the central spur gear moves in the second direction; and moving the at least one partition wall from the open position to the closed position when the at least one partition spur gear is rotated in the first direction.

Item 44: The method of item 43, wherein the motion conversion gear is configured to interact with the hub gear when the at least one blade driven by the hub gear is located within a determined angular distance from the at least one partition wall.

Item 45: The method of items 43 or 44, wherein the reciprocal gear system comprises: a first reciprocal gear in communication with the speed amplification gear and the central spur gear and configured to rotate in the second direction; and a second reciprocal gear in communication with the first reciprocal gear and the central spur gear and configured to rotate in the first direction; wherein the first reciprocal gear is rotated in the second direction when the at least one blade is within a predetermined distance of a first side of the at least one corresponding partition wall; and wherein the second reciprocal gear is rotated in the first direction when the at least one blade has moved to a second side of the at least one corresponding partition wall.

Item 46: The method of item 45, wherein the first reciprocal gear interacts with the central spur gear to rotate the central spur gear in the first direction and the second reciprocal gear interacts with the central spur gear to rotate the central spur gear in the second direction.

I claim:

1. A compressor device comprising:

an annular chamber comprising an inner wall and an outer wall;

at least one inlet port within the annular chamber, the annular chamber receiving air through the at least one inlet port configured to receive the air into the annular chamber;

at least one blade in communication with the inner wall and moveable around the annular chamber, the at least one blade configured to compress the air received from the at least one inlet port;

at least one partition wall between the inner wall and the outer wall moveable between a closed position and an open position, wherein the at least one partition wall is configured to close a space between the inner wall and the outer wall of the annular chamber when in the closed position, and configured to create space between the inner wall and the outer wall of the annular chamber when in the open position;

wherein when the at least one partition wall is in the closed position, the at least one blade approaching the at least one corresponding partition wall causes the air to compress to generate compressed air;

wherein when the at least one partition wall is in the open position, the at least one blade moves from a first side of the corresponding at least one partition wall to a second side of the at least one corresponding partition wall; and at least one outlet port within the annular chamber, the at least one outlet port configured to release the compressed air from the annular chamber after the at least one blade has moved to the second side of the at least one corresponding partition wall.

2. The compressor device of claim 1, wherein the at least one blade comprises at least three blades and the at least one partition wall comprises at least three partition walls, the at least three partition walls forming at least three interior chambers of the annular chamber when in the closed position.

3. The compressor device of claim 1, wherein the at least one blade is configured to create a suction force between the at least one blade and the second side of the at least one corresponding partition wall, drawing the air in from the inlet port into the annular chamber.

4. The compressor device of claim 1, wherein the at least one partition wall, when in a closed position, forms an airtight seal between the inner wall and the outer wall of the annular chamber.

5. The compressor device of claim 4, wherein the at least one partition wall is moveable between the closed position and the open position by a gearbox train, wherein the gearbox train is configured to open the at least one partition wall when the at least one blade is within a predetermined distance of and approaching the at least one partition wall, and wherein the gearbox train is configured to close the at least one partition wall when the at least one blade is within a second predetermined distance of and has passed the at least one corresponding partition wall.

6. The compressor device of claim 5, wherein the gearbox train comprises:

a hub gear in communication with the at least one blade and configured to continuously drive the at least one blade within the device;

a motion conversion gear in communication with the hub gear and configured to interact with the hub gear when the at least one blade is located within a predetermined angular distance from the at least one partition wall, wherein the motion conversion gear causes the conversion of continuous motion of the hub gear into intermittent motion of the motion conversion gear;

a speed amplification gear in communication with the motion conversion gear and configured to convert the intermittent motion of the motion conversion gear into a high-speed intermittent motion of the speed amplification gear;

a reciprocal gear system in communication with the speed amplification gear and configured to rotate when interacting with the speed amplification gear;

a central spur gear in communication with the reciprocal gear system and configured to rotate a predetermined degree in a first direction and a predetermined degree in a second direction opposing the first direction; and at least one partition spur gear in communication with the central reciprocal gear and configured to move the at least one partition wall;

wherein when the central spur gear moves in the first direction, the at least one partition spur gear is rotated in the second direction and wherein when the central spur gear moves in the second direction, the at least one partition spur gear is rotated in first direction;

wherein the at least one partition wall is moved from a closed position to an open position when the at least one partition spur gear is rotated in the second direction; and wherein the at least one partition wall is moved from the open position to the closed position when the at least one partition spur gear is rotated in the first direction.

7. The compressor device of claim 6, wherein the reciprocal gear system comprises:

a first reciprocal gear in communication with the speed amplification gear and the central spur gear and configured to rotate in the first direction; and a second reciprocal gear in communication with the first reciprocal gear and the central spur gear and configured to rotate in the second direction.

8. The compressor device of claim 7, wherein the second reciprocal gear interacts with the central spur gear to rotate the central spur gear in the first direction and the first reciprocal gear interacts with the central reciprocal gear to rotate the central spur gear in the second direction.

9. The compressor device of claim 6, wherein the motion conversion gear has a first layer of a hexagonal shape and a second layer above the first layer, the second layer having an involute curved profile.

10. A method of compressing air within a compressor device, the method comprising:

receiving air through at least one inlet port of the compressor device, the compressor device comprising:

an annular chamber comprising an inner wall and an outer wall;

the at least one inlet port within the annular chamber, the at least one inlet port configured to flow air into the annular chamber;

at least one blade in communication with the inner wall and moveable around the annular chamber, the at least one blade configured to compress the air flow from the at least one inlet port;

at least one partition wall between the inner wall and the outer wall moveable between a closed position and an open position, wherein the at least one partition wall is configured to close a space between the inner wall and the outer wall of the annular chamber when in the closed position, and configured to create space between the inner wall and the outer wall of the annular chamber when in the open position; and at least one outlet port within the annular chamber, the at least one outlet port configured to release the compressed air from the annular chamber;

moving the at least one blade in a continuous motion around the annular chamber;

compressing, between the at least one blade and the at least one partition wall in the closed position, the received air within the annular chamber; and outputting the compressed air through the at least one outlet port of the compressor device when the at least one partition wall is moved to the open position.

11. The method of claim 10, further comprising moving the at least one partition wall from the closed position to the open position to allow the at least one blade to move from a first side of the at least one partition wall to a second side of the at least one partition wall.

12. The method of claim 11, further comprising moving the at least one partition wall from the open position to the closed position after the at least one blade has moved to the second side of the at least one partition wall.

13. The method of claim 12, wherein the at least one blade comprises at least three blades and the at least one partition wall comprises least three partition walls, the at least three partition walls forming at least three interior chambers of the annular chamber when in the closed position.

14. The method of claim 10, further comprising creating a suction force between the at least one blade and the second side of the at least one partition wall, drawing the air flow in from the inlet port into the annular chamber.

15. The method of claim 10, wherein the at least one partition wall, when in a closed position, forms an airtight seal between the inner wall and the outer wall of the annular chamber.

16. The method of claim 15, further comprising moving the at least one partition wall between the closed position and the open position by a gearbox train, wherein the gearbox train is configured to open the at least one partition wall when the at least one blade is within a predetermined distance of and approaching the at least one partition wall, and wherein the gearbox train is configured to close the at least one partition wall when the at least one blade is within a second predetermined distance of and has passed the at least one corresponding partition wall.

17. The method of claim 16, further comprising:

driving the at least one blade around the annular chamber by a hub gear of the gearbox train, the hub gear in communication with a motion conversion gear;

converting, by the motion conversion gear, continuous movement of the hub gear to intermittent motion of the motion conversion gear;

rotating, by the motion conversion gear, a speed amplification gear configured to convert the intermittent motion of the motion conversion gear into a high-speed intermitted motion of the speed amplification gear;

rotating, by the speed amplification gear, a reciprocal gear system;

rotating, by the reciprocal gear system, a central spur gear configured to rotate a predetermined degree in a first direction and a predetermined degree in a second direction opposing the first direction;

rotating the at least one partition spur gear in a second direction when the central spur gear moves in the first direction;

moving the at least one partition wall from a closed position to an open position when the at least one partition spur gear is rotated in the second direction;

rotating the at least one partition spur gear in a first direction when the central spur gear moves in the second direction; and moving the at least one partition wall from the open position to the closed position when the at least one partition spur gear is rotated in the first direction.

18. The method of claim 17, wherein the motion conversion gear is configured to interact with the hub gear when the at least one blade driven by the hub gear is located within a determined angular distance from the at least one partition wall.

19. The method of claim 17, wherein the reciprocal gear system comprises:

a first reciprocal gear in communication with the speed amplification gear and the central spur gear and configured to rotate in the second direction; and a second reciprocal gear in communication with the first reciprocal gear and the central spur gear and configured to rotate in the first direction;

wherein the first reciprocal gear is rotated in the second direction when the at least one blade is within a predetermined distance of a first side of the at least one corresponding partition wall; and wherein the second reciprocal gear is rotated in the first direction when the at least one blade has moved to a second side of the at least one corresponding partition wall.

20. The method of claim 19, wherein the second reciprocal gear interacts with the central spur gear to rotate the central spur gear in the first direction and the first reciprocal gear interacts with the central spur gear to rotate the central spur gear in the second direction.

* * * * *